US006413712B1

(12) United States Patent
Yoshioka et al.

(10) Patent No.: US 6,413,712 B1
(45) Date of Patent: Jul. 2, 2002

(54) PHOTOTHERMOGRAPHIC MATERIAL

(75) Inventors: Yasuhiro Yoshioka; Makoto Suzuki, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/662,628

(22) Filed: Sep. 15, 2000

(30) Foreign Application Priority Data

Sep. 17, 1999 (JP) ..... 11-263899

(51) Int. Cl.[7] ..... G03C 1/498
(52) U.S. Cl. ..... 430/619; 430/531
(58) Field of Search ..... 430/619, 531

(56) References Cited

U.S. PATENT DOCUMENTS

| | | | | |
|---|---|---|---|---|
| 2,910,377 A | | 10/1959 | Owen | |
| 3,152,904 A | | 10/1964 | Sorensen et al. | |
| 3,457,075 A | | 7/1969 | Morgan et al. | |
| 3,889,776 A | | 6/1975 | Postma | |
| 5,686,228 A | * | 11/1997 | Murray et al. | 430/350 |

FOREIGN PATENT DOCUMENTS

| | | |
|---|---|---|
| EP | 0803764 A1 | 10/1997 |
| GB | 1441223 | 6/1976 |
| JP | 434924 | 2/1943 |
| JP | 434924 B | 2/1943 |
| JP | 5022135 | 3/1975 |
| JP | 5036110 | 4/1975 |
| JP | 5151933 A | 5/1976 |
| JP | 5151933 | 5/1976 |
| JP | 52084727 A | 7/1977 |
| JP | 06003793 A | 1/1994 |

OTHER PUBLICATIONS

Donald H. Klosterboer, Thermally Processed Silver Systems, Imaging Processes and Materials, Neblette's Eighth Edition, Chapter 9, pp. 279–291 (1989).

D. Klosterboer, Thermally Processed . . . , Imaging Processes and Materials, Neblette's 8th Ed., Chapter 9, p. 279, 1989.

* cited by examiner

*Primary Examiner*—Thorl Chea
(74) *Attorney, Agent, or Firm*—Birch, Stewart, Kolasch & Birch, LLP

(57) ABSTRACT

A photothermographic material affording a sufficient image density under general image producing conditions and capable of suppressing the time-dependent tint of the white background after the development processing is provided. Such photothermographic material contains in elsewhere on one side of a support at least one species of photosensitive silver halide, a non-photosensitive organic silver salt, a reducing agent for reducing silver ion and a binder, in which the reducing agent comprises a combination of at least one species of o-polyphenol compound and at least one species of hindered phenol.

14 Claims, No Drawings

PHOTOTHERMOGRAPHIC MATERIAL

FIELD OF THE INVENTION

The present invention relates to a photothermographic material.

RELATED ARTS

A strong need for reducing the volume of waste process solution has arisen in recent particular diagnosis field from viewpoints of environmental preservation and space saving. Thus a technology related to a thermally processed image forming material for particular diagnosis and photographic purposes has been desired, the material being such that allowing efficient light exposure with a laser image setter or laser imager, and providing a black image with a high resolution and sharpness. Such thermally processed image forming material can provide the user with a more simple and environment-conscious image producing system using no solution-base process chemical.

While a similar need has been occurring in the field of general image forming materials, images used in the particular diagnosis field specifically require a high image quality such as excellent sharpness and graininess for fine depiction, and prefer a blue-black tone for facilitating diagnoses. Although various hard copy system using pigment or dye, exemplified as an inkjet printer and electronic photograph system, are prevailing as a general image forming system, none of which is satisfactory as an output system for particular images.

Other type of thermally processed image forming material using an organic silver salt is known, for example, in U.S. Pat. Nos. 3,152,904 and 3,457,075 and"Thermally Processed Silver Systems" by D. Klosterboer, Imaging Processes and Materials, Neblette's 8th ed., edited by J. Sturge, V. Walworth and A. Shepp, chapter 9, p.279, (1989). In particular, the photothermographic material generally has a photosensitive layer comprising a catalytic amount of a photocatalyst (e.g., silver halide), a heat developing agent, a reducible silver salt (e.g., organic silver salt), and an optional toning agent for controlling tone of silver image, all of which being dispersed in a binder matrix. The photothermographic material produces a blackened silver image when heated, after light exposure, to a high temperature (e.g., 80° C. or above) through redox reaction of the silver halide or reducible silver salt with the reducing agent. Since the redox reaction is promoted by a catalytic action of silver halide composing a latent image, which is produced by the light exposure, that the blackened silver image is formed in the exposed area. Such heat-assisted image producing system is disclosed in numbers of literatures typified by U.S. Pat. No. 2,910,377 and JP-B-43-4924 (the code "JP-B-" as used in this specification means an"examined Japanese patent publication"), and recently Fuji Particular Dry Imager FM-DPL was launched as a particular image producing system using such photothermographic material.

In the photothermographic material, o-bisphenol-base reducing agents as expressed by the formula (I) are effectively used by virtue of their high activity. These compounds are disclosed, for example, in European Pat. No. 803,764, JP-A-51-51933 (the code"JP-A-" as used in this specification means an"unexamined published Japanese patent application"), and JP-A-6-3793. A problem, however, resides in that such photothermographic material is likely to tint in the white background region during a long term storage after the processing, since such photosensitive material is not subjected to fixation treatment after the processing and thus heat-sensitive organic acid silver salt and the reducing agent will remain intact within the photosensitive material. While decreasing the amount of use of the o-bisphenol-base reducing agent will be necessary to solve such problem of the tint in the white background, this may contradict the primary goal of the present invention to achieve a sufficient image density, so that it has been difficult to obtain a sufficient image density while suppressing the tint.

SUMMARY OF THE INVENTION

It is therefore an object of the present invention to solve the foregoing problem in the prior art. That is, an object of the present invention is to provide a photothermographic material affording a sufficient image density under general image producing conditions and capable of suppressing the time-dependent tint of the white background after the development processing.

The present inventors found out, after extensive studies, that a preferable photothermographic exhibiting desired function can be fabricated by using, as a reducing agent, specific compounds in combination, which led us to propose the present invention.

That is, the present invention provides (1) a photothermographic material containing in elsewhere on one side of a support at least one species of photosensitive silver halide, a non-photosensitive organic silver salt, a reducing agent for reducing silver ion and a binder, in which the reducing agent comprises a combination of at least one species of o-polyphenol compound and at least one species of hindered phenol; and (2) a photothermographic material containing in elsewhere on one side of a support at least one species of photosensitive silver halide, a non-photosensitive organic silver salt, a reducing agent for reducing silver ion and a binder, in which the reducing agent comprises a combination of at least one species of compound expressed by the formula (I) below and at least one species of compound expressed by the formula (II) below:

formula (I)

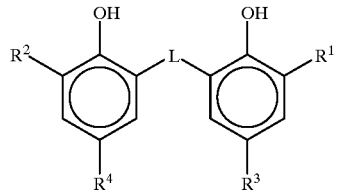

(where in the formula (I), $R^1$ to $R^4$ independently represent a hydrogen atom or a group substitutable on a benzene ring; L represents an -S- group or a —$CHR^5$— group; said $R^5$ representing a hydrogen atom or an alkyl group); and formula (II)

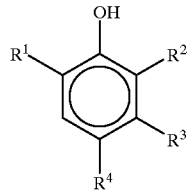

(where in the formula (II), $R^1$ represents an alkyl group whereas excluding 2-hydroxyphenylmethyl group;

$R^2$represents a hydrogen atom or an acylamino group; $R^3$ represents a hydrogen atom or an alkyl group; and $R^4$ represents a group substitutable on a benzene ring).

According to the present invention, concomitant improvement both in the development density and image storability can be achieved by using o-polyphenol-base reducing agents [compounds expressed by the formula (I)] and the hindered phenol-base reducing agents [compounds expressed by the formula (II)] in combination. It is thus possible according to the present invention to provide a photothermographic material affording a sufficient image density under general image producing conditions while suppressing the time-dependent tint of the white background after the development processing.

DETAILED DESCRIPTION OF THE INVENTION

The present invention will be detailed hereinafter.

The photothermographic material of the present invention contains in elsewhere on one side of a support at least one species of photosensitive silver halide, a non-photosensitive organic silver salt, a reducing agent for reducing silver ion and a binder. Such photothermographic material according to the first aspect of the present invention is characterized in that containing as the reducing agent at least one species of o-polyphenol compound and at least one species of hindered phenol used in combination.

As has previously been described in the specification, the o-polyphenol compound expressed by the formula (I) is a known reducing agent for use in the photothermographic-material. The hindered phenol compound expressed by the formula (II) is also disclosed in European Pat. No. 803,764, JP-A-50-22135, JP-A-50-36110, JP-A-52-84727, and JP-A-6-3793. The hindered phenol-base reducing agent was, however, low in heat-developing activity while causing less tint in the white background, so that it was difficult to obtain an image with a sufficient density at a practical reaction temperature and within a practical reaction time. The present inventors found after extensive studies that using these compounds, independently known as a reducing agent, in combination resulted in amazing effects in that the image density was dramatically increased beyond expectation as compared with that obtainable in the case of independent use of such compounds, and in that the storability of the image was concomitantly improved. As judged from such effects, both compounds as reducing agents are considered to be function as heat developing agents.

The o-polyphenol compound available in the present invention refers to a compound consisting of a plurality of phenols bound with each other at the ortho positions. It is not always necessary that the compound has two or more hydroxyl groups on one benzene ring.

Preferable o-polyphenol compound relates to a compound composed of two phenol molecules bound with each other at the ortho positions. More specifically, the compound expressed by the formula (I) is preferable. Such compound expressed by the formula (I) will be detailed hereinafter.

In the formula (I), $R^1$ and $R^2$ independently represent a hydrogen atom or a substituent substitutable on the benzene ring, and both of which may be the same or may differ with each other. The substituent substitutable on the benzene ring is typified as alkyl group with a carbon number of 1 to 30, aryl group with a carbon number of 6 to 36, halogen atom, alkoxy group with a carbon number of 1 to 30 and acylamino group with a carbon number of 1 to 30. $R^1$ and $R^2$ are preferably alkyl group with a carbon number of 1 to 24, more preferably tertiary alkyl group, and specifically, methyl group, ethyl group, propyl group, butyl group, isopropyl group, t-butyl group, t-amyl group, cyclohexyl group, 1-methylcyclohexyl group, benzyl group and acetylamino group. Among these, more preferable are a methyl group, isopropyl group and t-butyl group, most preferable is t-butyl group.

$R^3$and $R^4$independently represent a hydrogen atom or a substituent substitutable on the benzene ring, and both of which may be the same or may differ with each other. They can be selected also independent of $R^1$ and $R^2$. The substituent substitutable on the benzene ring is typified as halogen atom, alkyl group with a carbon number of 1 to 30, aryl group with a carbon number of 6 to 36, alkoxy group with a carbon number of 1 to 30, acylamino group with a carbon number of 1 to 30, sulfonamide group with a carbon number of 0 to 30, acyl group with a carbon number of 1 to 30, carbamoyl group with a carbon number of 1 to 30, sulfamoyl group with a carbon number of 0 to 30, alkoxycarbonyl group with a carbon number of 2 to 30, and sulfonyl group with a carbon number of 1 to 30. $R^3$ and $R^4$are preferably alkyl group with a carbon number of 1 to 24, and more specifically, methyl group, ethyl group, propyl group, butyl group, isopropyl group, t-butyl group, t-amyl group, cyclohexyl group, 1-methylcyclohexyl group, acetylaminomethyl group and benzyl group. Among these, more preferable are methyl group, ethyl group, isopropyl group and t-butyl group, and methyl group and ethyl group are most preferable.

L represents an —S— group or a —$CHR^5$— group.

$R^5$ represents a hydrogen atom or an alkyl group with a carbon number of 1 to 30. The alkyl group may be unsubstituted or substituted with any other group.. Specific examples of the unsubstituted alkyl group include methyl group, ethyl group, propyl group, butyl group, heptyl group, undecyl group, isopropyl group, 1-ethylpentyl group, and 2,4,4-trimethylpentyl group. Possible substituents for the alkyl group include halogen atom, alkoxy group, alkylthio group, aryloxy group, arylthio group, acylamino group, sulfonamide group, sulfonyl group, phosphoryl group, oxycarbonyl group, carbomoyl group and sulfamoyl group. $R^5$is preferably a hydrogen atom or an alkyl group with a carbon number of 1 to 24, and the alkyl group is preferably a methyl group, propyl group, isopropyl group or 2,4,4-trimethylpentyl group.

Specific examples of the o-polyphenol compound or the compounds expressed by the formula (I) are shown below, while being not limited thereto:

(I-1)

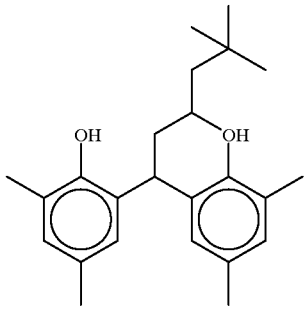

-continued
(I-2)
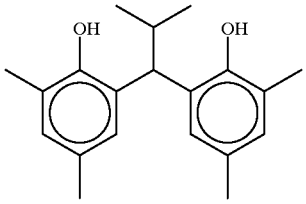
(I-3)
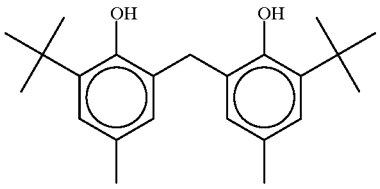
(I-4)
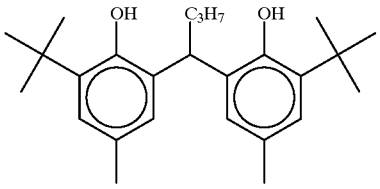
(I-5)
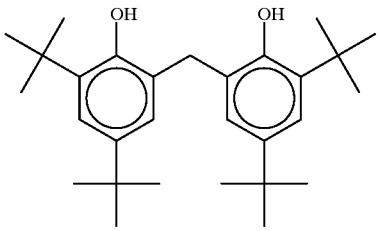
(I-6)
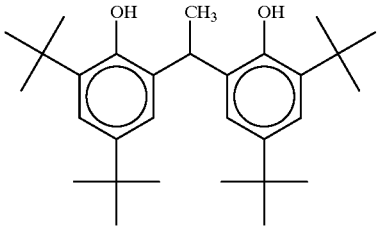
(I-7)
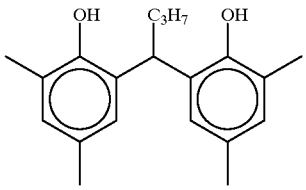
(I-8)
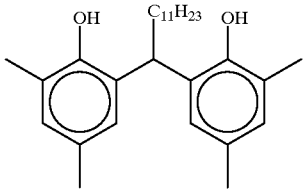
-continued
(I-9)
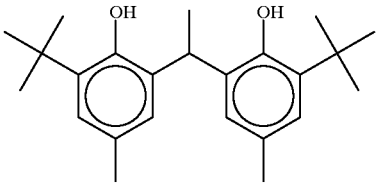
(I-10)
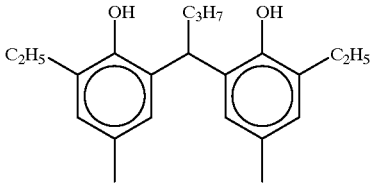
(I-11)
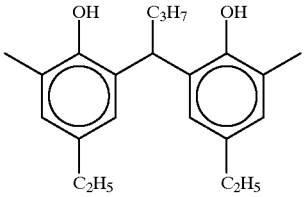
(I-12)
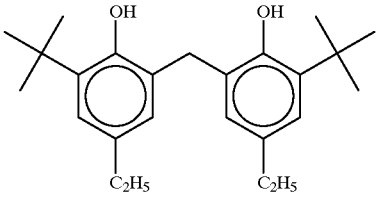
(I-13)
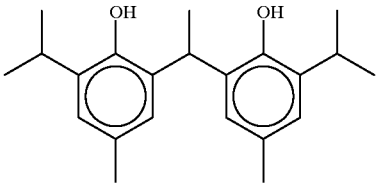
(I-14)
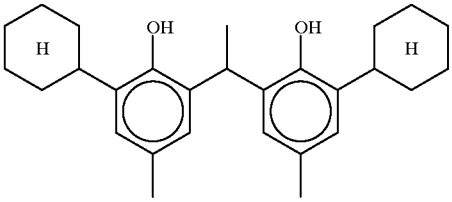
(I-15)
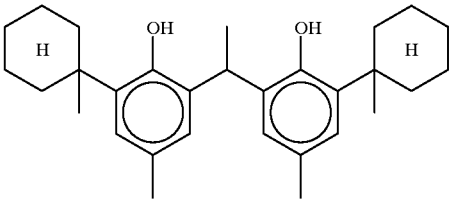

(I-16)
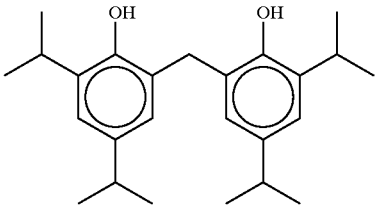
(I-17)
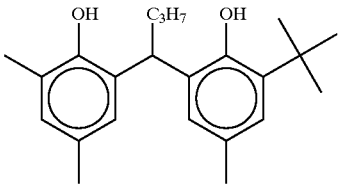
(I-18)
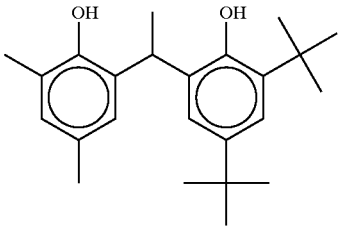
(I-19)
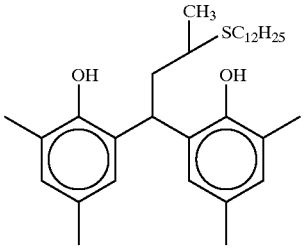
(I-20)
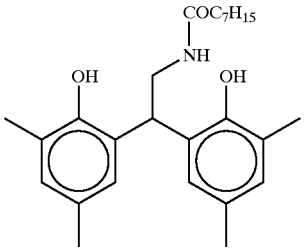
(I-21)
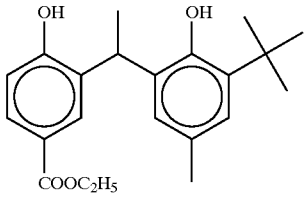
(I-22)
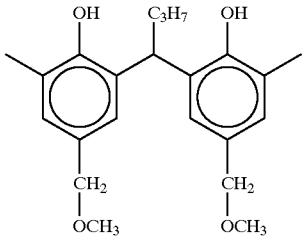
(I-23)
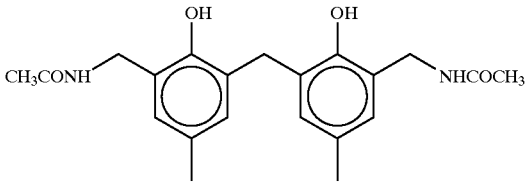
(I-24)
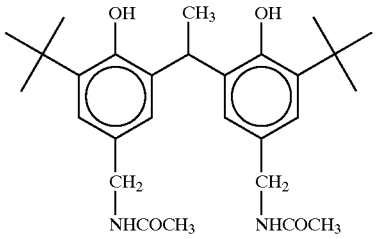
(I-25)
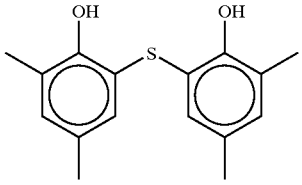
(I-26)
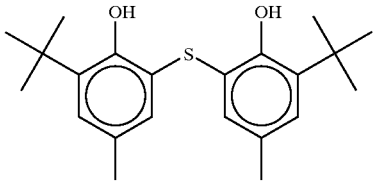
(I-27)
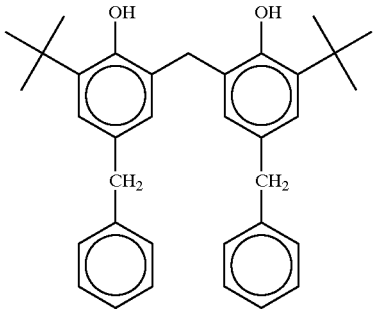

-continued (I-28)

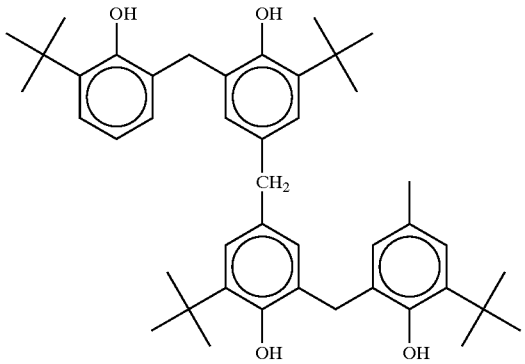

Besides the compounds listed above, the o-polyphenol compound or the compounds expressed by the formula (I) are also specifically disclosed in European Pat. No. 803,764, JP-A-51-51933 and JP-A-6-3793.

The hindered phenol compound available in the present invention is such that having substituents other than hydrogen atoms on both of two ortho positions, or such that having a hydrogen atom on one of two ortho positions and having a substituent exhibiting steric hindrance on the other ortho position.

When the hindered phenol has substituents other than hydrogen atoms on both of two ortho positions, such substituent may be the group substitutable on the benzene ring as listed for $R^3$of the formula (I), where at least one of which is preferably an alkyl group, and more specifically a methyl group, ethyl group, butyl group, octyl group, isopropyl group, t-butyl group, t-octyl group, t-amyl group, sec-butyl group, cyclohexyl group or 1-methylcyclohexyl group; and more preferably a group exhibiting equivalent or larger steric hindrance than isopropyl group (e.g., isopropyl group, isononyl group, t-butyl group, t-amyl group, t-octyl group, cyclohexyl group, 1-methyl-cyclohexyl group, 1-benzylcyclohexyl group and adamantyl group); and among these still more preferable is tertiary alkyl group. Such substituent exhibiting steric hindrance may be bound to both of two ortho positions or may be bound to either one of them.

When the hindered phenol has a hydrogen atom on one of two ortho positions and has a substituent exhibiting steric hindrance on the other ortho position, such substituent may preferably be a group exhibiting larger steric hindrance than isopropyl group, and among these more-preferable is a tertiary alkyl group. The substituent exhibiting steric hindrance may be the same as those described above.

The hindered phenol compound is preferably such that expressed by the formula (II). Such compound expressed by the formula (II) will be detailed hereinafter.

When $R^2$in the formula (II) represents a substituent other than a hydrogen atom, $R^1$ represents an alkyl group. The alkyl group preferably has a carbon number of 1 to 30, and may be unsubstituted or substituted. Examples of the unsubstituted alkyl group include methyl group, ethyl group, butyl group, octyl group, isopropyl group, t-butyl group, t-octyl group, t-amyl group, sec-butyl group, cyclohexyl group and 1-methyl-cyclohexyl group, and more preferably a group exhibiting equivalent or larger steric hindrance than isopropyl group (e.g., isopropyl group, isononyl group, t-butyl group, t-amyl group, t-octyl group, cyclohexyl group, 1-methyl-cyclohexyl group, 1-benzylcyclohexyl group and adamantyl group); and among these still more preferable is tertiary alkyl group. For the case that $R^1$ has a substituent, such substituent may be a halogen atom, aryl group, alkoxy group, amino group, acyl group, acylamino group, alkylthio group, arylthio group, sulfonamide group, acyloxy group, oxycarbonyl group, carbamoyl group, sulfamoyl group, sulfonyl group or phosphoryl group.

$R^2$ represents a hydrogen atom, alkyl group with a carbon number of 1 to 30 or acylamino group with a carbon number of 1 to 30, where as for the alkyl group the description for $R^1$ will apply thereto. The acylamino group may be unsubstituted or substituted, and is exemplified as an acetylamino group, alkoxyacetylamino group or aryloxyacetylamino group. $R^2$ is preferably a hydrogen atom or unsubstituted alkyl group with a carbon number of 1 to 24, and more specifically a methyl group, isopropyl group or t-butyl group.

$R^3$ represents a hydrogen atom or an alkyl group with a carbon number of 1 to 30, where as for the alkyl group the description for $R^1$ will apply thereto. $R^3$ is preferably a hydrogen atom or unsubstituted alkyl group with a carbon number of 1 to 24, and more specifically a methyl group, isopropyl group or t-butyl group.

It is preferable that either one of $R^2$ and $R^3$ is a hydrogen atom.

$R^4$ represents a group substitutable on the benzene ring, and is same as those described for $R^3$ and $R^4$ of the compound expressed by the formula (I). $R^4$ is preferably a substituted or unsubstituted alkyl group with a carbon number of 1 to 30 or oxycarbonyl group with a carbon number of 2 to 30, where more preferable is an alkyl group with a carbon number of 1 to 24. Substituents for the alkyl group include aryl group, amino group, alkoxy group, oxycarbonyl group, acylamino group, acyloxy group, imide group and ureide group, and among which preferable are aryl group, amino group, oxycarbonyl group and alkoxy group. Specific examples of the hindered phenol-base reducing agent or the compounds expressed by the formula (II) are shown below, while being not limited thereto:

(II-1)

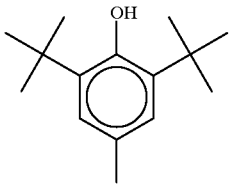

(II-2)

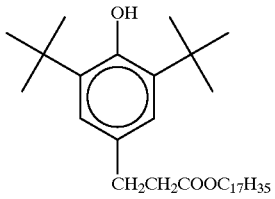

-continued
(II-3)
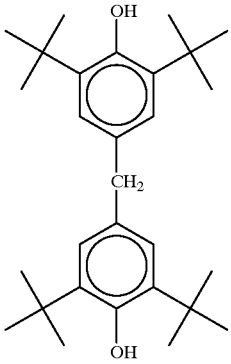
(II-4)
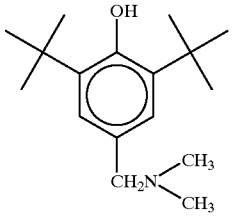
(II-5)
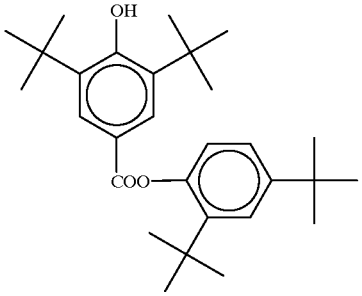
(II-6)
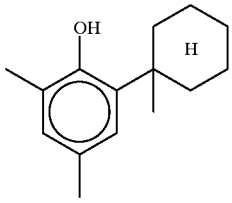
(II-7)
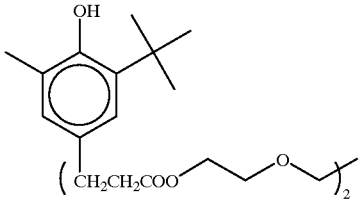
(II-8)
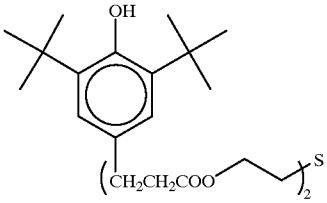
(II-9)
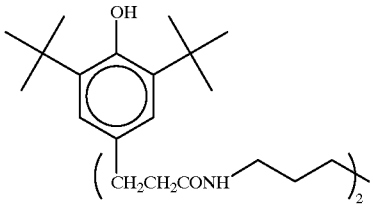
(II-10)
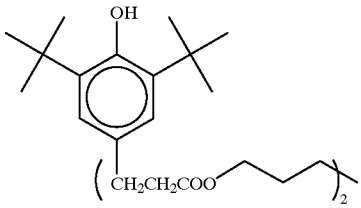

-continued
(II-11)
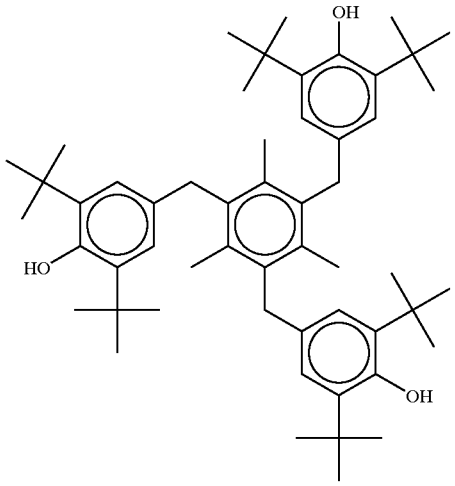
(II-12)
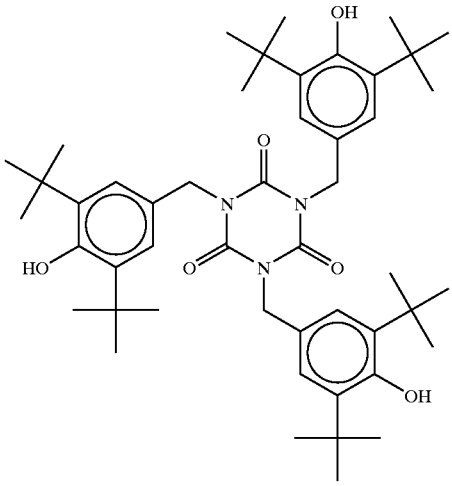
(II-13)
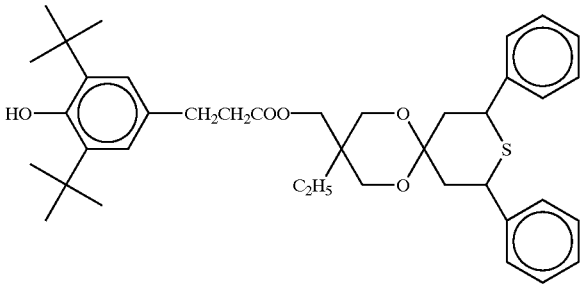
(II-14)
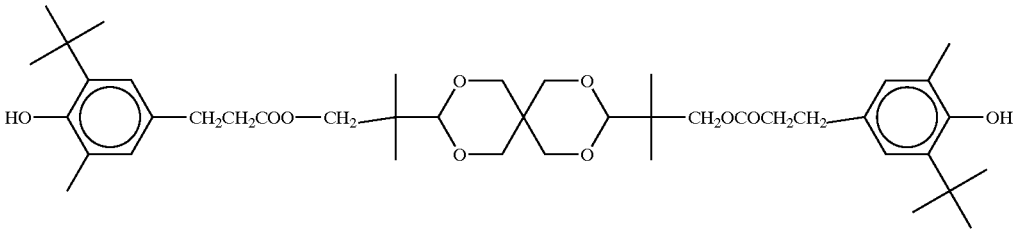
(II-15)
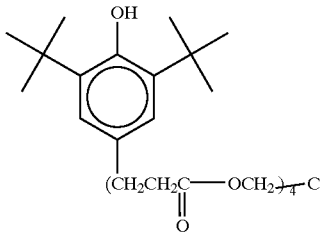
(II-16)
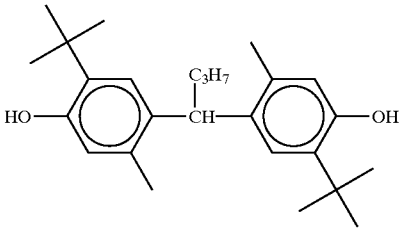
(II-17)
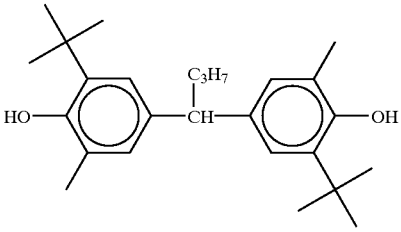
(II-18)
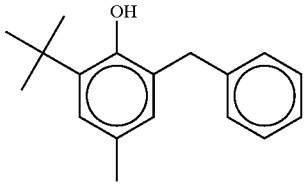

-continued
(II-19)
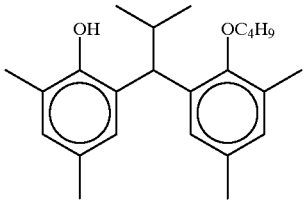
(II-20)
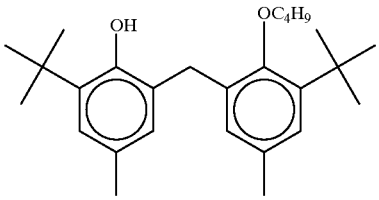
(II-21)
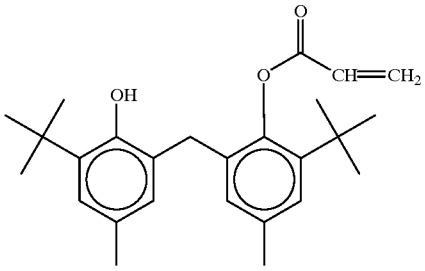
(II-22)
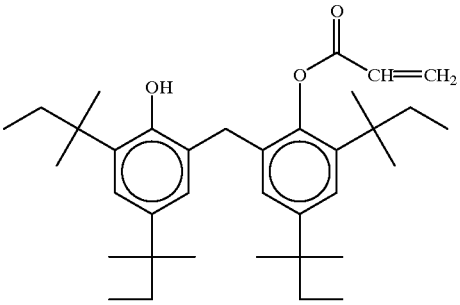
(II-23)
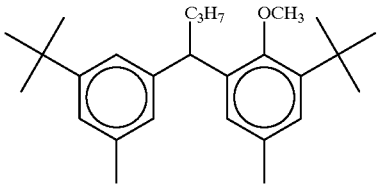
(II-24)
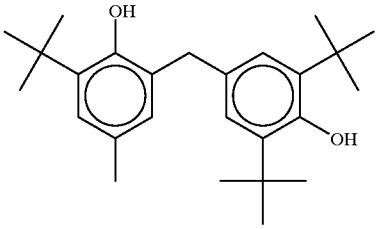
(II-25)
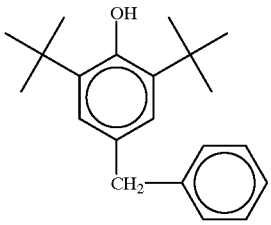
(II-26)
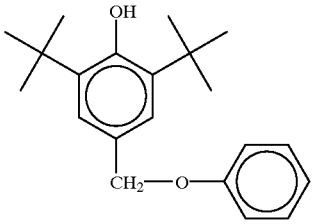
(II-27)
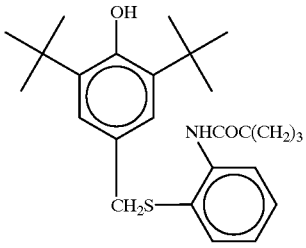
(II-28)
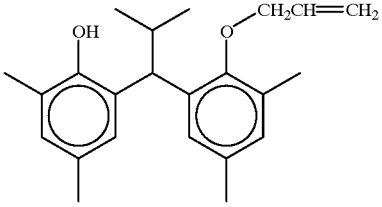

-continued (II-29)

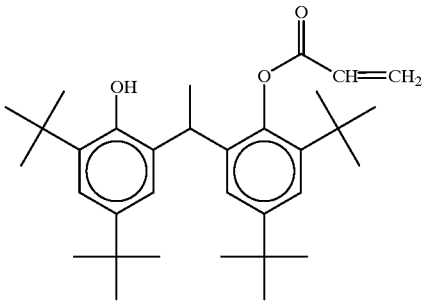

(II-30)

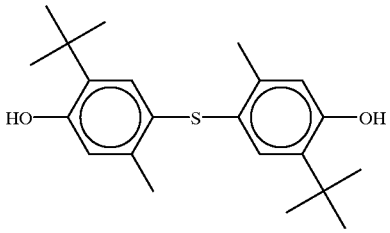

(II-31)

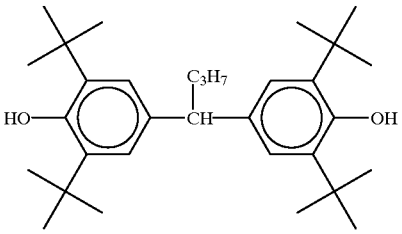

(II-32)

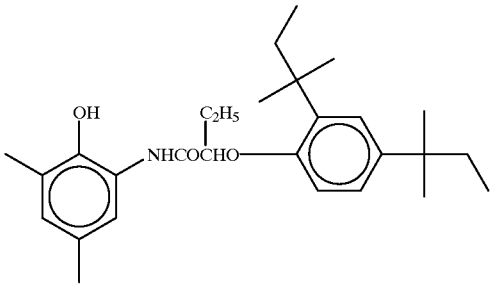

(II-33)

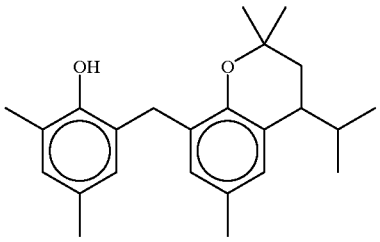

(II-34)

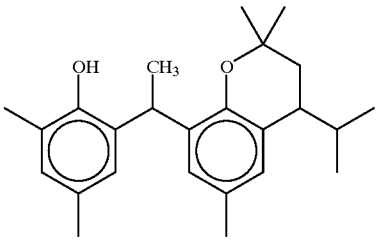

Besides the compounds listed above, the hindered phenol compound or the compounds expressed by the formula (II) are also specifically disclosed in European Patent No.803, 764, JP-A-50-22315, JP-A-50-36110, JP-A-52-84727 and JP-A-6-3793.

The individual amounts of addition of the o-polyphenol-base reducing agent [reducing agent expressed by the formula (I)] and the hindered phenol-base reducing agent [reducing agent expressed by the formula (II)] are preferably 0.01 to 4.0 g/m$^2$, and more preferably 0.1 to 2.0 g m$^2$. The preferable range is also expressed as 2 to 40 mol % of total silver contained elsewhere on the plane having the image producing layer, and more preferably 5 to 30 mol %. The ratio of amount of addition (molar ratio) of the o-polyphenol-base reducing agent [compound expressed by the formula (I)] and the hindered phenol-base reducing agent [compound expressed by the formula (II)] is preferably 0.001 to 10, more preferably 0.005 to 10, still more preferably 0.1 to 10, and most preferably 0.2 to 2.0.

While the o-polyphenol-base reducing agent [compound expressed by the formula (I)] and the hindered phenol-base reducing agent [compound expressed by the formula (II)] are preferably added to the image producing layer containing the organic silver salt, it is also allowable that either of which is added to the image producing layer and the other is added to the non-image producing layer adjacent thereto, and further it may be allowable that both of which are added to the non-image producing layer. For the case that the image producing layer is composed of a plurality of layers, individual compounds may be contained in the separate layers.

The reducing agent can be incorporated into the photosensitive material through coating the coating liquid in an arbitrary form such as solution, emulsified dispersion, solid microgram dispersion and so forth.

A well-known :method for preparing an emulsified dispersion relates to dissolving the compounds in oil such as dibutyl phthalate, tricresyl phosphate, glyceryl triacetate and diethyl phthalate, or in auxiliary solvent such as ethyl acetate and cyclohexanone, and then mechanically emulsifying the mixture.

A method for obtaining solid microgram dispersion relates to dispersing the powder of the reducing agent into an appropriate solvent such as water using ball mill, vibrating ball mill, sand mill, colloid mill, jet mill, roller mill or ultrasonic wave. It is also allowable in this process to use a protective colloid (e.g., polyvinyl alcohol) or an anionic surfactant (for example, sodium triisopropylnaphthalenesulfonate as a mixture of isomers differed in the substitution sites by three isopropyl groups). The water-base dispersion can contain a preservative (e.g., sodium salt of benzoisothiazolinone).

The organic silver salt available in the present invention is such that being relatively stable against light exposure but can produce silver image when heated at 80° C. or higher in the presence of light-exposed photocatalyst (e.g., latent image of photosensitive silver halide) and reducing agent. The organic silver salt may be any organic substance containing a source capable of reducing the silver ion. Such non-photosensitive organic silver salt is disclosed in the paragraphs [0048] to [0049] of JP-A-10-62899 and line 24 on page 18 to line 37 on page 19 of European Pat. No. 0803763A1. Silver salt of organic acid, in particular, silver salt of long-chained aliphatic carboxylic acid (with a carbon number of 10 to 30, and preferably 15 to 28) is preferred. Examples thereof include silver behenate, silver arachidinate, silver stearate, silver oleate, silver laurate, silver caproate, silver myristate, silver palmitate and mixtures thereof.

While there is no particular limitation on grain shape of the organic silver salt available in the present invention, scaly organic silver salt is preferable. The scaly organic silver salt in the present invention is now defined as follows. The grain of the organic silver salt is microscopically observed and the shape thereof is approximated as a rectangular parallelepiped. Edges of the rectangular parallelepiped are denoted as "a","b" and"c" in the order from the shortest length ("c" may be equal to"b"), then x=b/a is calculated for approx. 200 grains and obtain an average "x(average)" thereof, in which those satisfying a relation of x(average)≧1.5 are defined as scaly, preferably satisfying 30≧x(average)≧1.5, and more preferably 20≧x(average)≧2.0. For reference, acicular form is defined for those satisfying a relation of 1≧x(average)<1.5.

As for a scaly grain, "a" can be assumed as a thickness of a tabular grain having a major plane surrounded by edges "b" and "c". An average of "a" is preferably 0.01 to 0.23 μm, and more preferably 0.1 to 0.20 μm. An average of "c/b" is preferably 1 to 6, more preferably 1.05 to 4, still more preferably 1.1 to 3, and most preferably 1.1 to 2.

Grain size distribution of the organic silver salt is preferably of monodisperse. The term"monodisperse" as used herein means that the percentage of the value obtained by dividing the standard deviation of the length of the short axis and long axis respectively by the length of the short axis and long axis is preferably 100% or less, more preferably 80% or less, still more preferably 50% or less. Shape of the organic silver salt grain can be measured based on an image of the organic silver salt dispersion observed through a transmission electron microscope. Another method for determining the monodispersibility is such that obtaining the standard deviation of volume weighted mean diameter of the organic silver salt. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light intensity; and thereby obtaining grain size (volume weighted mean diameter).

The organic silver salt for use in the present invention can be prepared by reacting a solution or suspension of alkali metal salt (exemplified as sodium salt, potassium salt and lithium salt) of the above-described organic acid with silver nitrate. The alkali metal salt of the organic acid is obtained by alkali treatment of the above-described organic acid. The organic silver salt can be prepared in an arbitrary proper vessel in a batch or continuous manner. Stirring in the reaction vessel may be effected with an arbitrary stirring method according to target properties of the grains. Preferable methods applicable for preparing the organic silver salt include such that adding abruptly or gradually an aqueous silver nitrate solution into a reaction vessel containing a solution or suspension of the alkali metal salt of the organic acid; such that adding abruptly or gradually a previously prepared solution or suspension of the alkali metal salt of the organic acid into a reaction vessel containing an aqueous silver nitrate solution; and such that pouring at a time into a reaction vessel an aqueous silver nitrate solution and a solution or suspension of the alkali metal salt of the organic acid, both of which being previously prepared.

The aqueous silver nitrate solution, and solution or suspension of the alkali metal salt of the organic acid may be of an arbitrary concentration and may be added at an arbitrary rate of addition to control the grain size of the organic silver salt to be prepared. The addition of the aqueous silver nitrate solution, or solution as well as suspension of the alkali metal salt of the organic acid may be effected at a constant addition rate, or accelerated or decelerated addition rate according to an arbitrary time-related function. Either addition onto the surface of the solution or deep into the solution are allowable. When an aqueous silver nitrate solution and a solution or suspension of the alkali metal salt of the organic salt, both being previously prepared, are poured at a time into a reaction vessel, either the aqueous silver nitrate solution, or the solution or suspension of the alkali metal salt of the organic acid may precedently poured, where the aqueous silver nitrate solution is preferably poured in a preceding manner. A degree of the precedence may preferably be 0 to 50 vol % of the total addition, and more preferably 0 to 25 vol%. It is also preferable as disclosed in JP-A-9-127643 to add the solution while controlling pH or silver potential of the reaction solution during the reaction.

The aqueous silver nitrate solution, or the solution or suspension of the alkali metal salt of the organic acid may have pH thereof adjusted according to target properties of the resultant grains. An arbitrary acid or alkali can be added for the pH control. Temperature of the content in the reaction vessel can arbitrarily be set according to the required characteristics, and for example to control the grain size of the organic acid silver salt, and the same will apply to the aqueous silver nitrate solution to be added, or the solution or suspension of the alkali metal salt of the organic acid to be added. The solution or suspension of the alkali metal salt of the organic acid is preferably kept by heating at 50° C. or above to ensure a proper fluidity thereof.

The organic acid silver salt for use in the present invention is preferably prepared in the presence of a tertiary alcohol. The tertiary alcohol used in the present invention preferably has a total carbon number of 15 or below, and more preferably 10 or below. A preferable example of such tertiary alcohol relates to t-butanol, while being not limited thereto. While the tertiary alcohol used in the present invention may be added at any timing during the preparation of the organic silver salt, it is preferable to add the alcohol at the time of preparation of the alkali metal salt of the organic acid and to use the alkali metal salt of the organic acid in a dissolved state. The amount of addition of the tertiary alcohol may be set at an arbitrary ratio by weight within a range from 0.01 to 10 relative to water as a solvent used for preparing the organic acid silver salt, and preferably from 0.03 to 1.

When the scaly organic acid silver salt valuable in the present invention is produced by reacting an aqueous solution containing a water-soluble silver salt and an aqueous tertiary alcohol solution containing the alkali metal salt of the organic acid (including a step for adding into a liquid in the reaction vessel an aqueous tertiary alcohol solution containing the alkali metal salt of the organic acid), it is preferable to keep the temperature difference between the solution in the reaction vessel and the aqueous tertiary alcohol solution containing the alkali metal salt of the organic acid within a range from 20 to 85° C.; the solution in the reaction vessel being preferably a pre-charged aqueous solution containing the water-soluble silver salt, or, for the case that the aqueous solution containing the water-soluble silver salt is added, rather than in precedence, at the same time with the aqueous tertiary alcohol solution containing the alkali metal salt of the organic acid, being water or a mixed solvent of water and the tertiary alcohol, which may previously be contained in the vessel also for the case that the aqueous solution containing the water-soluble silver salt is previously poured.

Crystal form or the like of the organic acid silver salt is preferably controlled by keeping such temperature difference during the addition of the aqueous tertiary alcohol solution containing the alkali metal salt of the organic acid.

The water-soluble silver salt is preferably silver nitrate, and the concentration of the water-soluble silver salt in the aqueous solution is preferably 0.03 to 6.5 mol/l, more preferably 0.1 to 5 mol/l, and pH of the aqueous solution is preferably 2 to 6, more preferably pH 3.5 to 6.

A tertiary alcohol with a carbon number of 4 to 6 may be contained, content by volume of which being 70% or less by volume relative to the total volume of the aqueous solution of the water-soluble silver salt, and more preferably 50% or less. Temperature of such aqueous solution is preferably 0 to 50° C., more preferably 5 to 30° C., and most preferably 5 to 15° C. in particular for the case that the aqueous solution containing the water-soluble silver salt and the aqueous tertiary alcohol solution containing the alkali metal salt of the organic acid are added at a time as described later.

The alkali metal composing the alkali metal salt of the organic acid is typified as sodium or potassium. The alkali metal salt of the organic acid is prepared by adding NaOH or KOH to an organic acid, in which it is preferable to suppress an amount of the alkali metal equivalent to or less than that of the organic acid so that a part of the organic acid will remain unreacted. An amount of the residual organic acid is 3 to 50 mol % relative to mol of the total organic acid, and preferably 3 to 30 mol %. It is also allowable in the preparation to add an excessive amount of alkali and then add acid such as nitric acid or sulfuric acid to neutralize the excessive portion of alkali.

Controlling pH is also allowable depending on target properties of the organic acid silver salt. An arbitrary acid or alkali can be used for the pH control.

The aqueous solution containing-the water-soluble silver salt, the aqueous tertiary alcohol solution containing the alkali metal salt of the organic acid, and the pre-charged solution in the reaction vessel may be added with, for example, a compound expressed by the formula (1) of JP-A-62-65035, a water-soluble N-heterocyclic compound having a solubility-expressing group as disclosed in JP-A-62-150240, an inorganic peroxide as disclosed in JP-A-50-101019, a sulfur compound as disclosed in JP-A-51-78319, a disulfide compound as disclosed in JP-P,-57-643 and hydrogen peroxide.

The aqueous tertiary alcohol solution containing the alkali metal salt of the organic acid used in the present invention is preferably a mixed solvent of a tertiary alcohol with a carbon number of 4 to 6 and water to ensure uniformity of the solution. A carbon number exceeding the above range is undesirable since such alcohol is not compatible with water. Among alcohols with a carbon number of 4 to 6, most preferable is t-butanol which is most compatible with water. Alcohols other than tertiary alcohol are not preferable as described above since such alcohols have reducing properties and will thus adversely affect the preparation of the organic acid silver salt. Amount by volume of the tertiary alcohol used in the aqueous tertiary alcohol solution containing the alkali metal salt of the organic acid is 3 to 70% of the volume of the aqueous portion of such aqueous tertiary alcohol solution, and more preferably 5 to 50%.

A concentration by weight of the alkali metal salt of the organic acid in the aqueous tertiary alcohol solution containing thereof is 7 to 50 wt%, more preferably 7 to 45% and still more preferably 10 to 40 wt%.

Temperature of the aqueous tertiary alcohol solution containing the alkali metal salt of the organic acid to be charged into the reaction vessel is maintained preferably within a range from 50 to 90° C., more preferably from 60 to 85° C., and most preferably from 65 to 85° C., so as to avoid crystallization or solidification of the alkali metal salt of the organic acid. The temperature is preferably be controlled at a certain level selected from the above range to keep the reaction temperature constant.

The organic acid silver salt used in the present invention is prepared either by i) a method such that the aqueous tertiary alcohol solution containing the alkali metal salt of the organic acid is poured by a single addition process operation into the reaction vessel pre-charged with an entire volume of the solution containing the water-soluble silver salt; or ii) a method such that having a time period in which the aqueous solution of the water-soluble silver salt and the aqueous tertiary alcohol solution containing the alkali salt of the organic acid are concomitantly added (concomitant addition process). The latter method based on the concomitant addition is more preferable in the present invention in terms of controlling the average grain size of the organic acid silver salt and narrowing the distribution thereof. In such a case, it is preferable that 30 vol% or more of the total addition is concomitantly added, and more preferably 50 to 75 vol%. When either solution is precedently added, the solution containing the water-soluble silver salt in precedence is more preferable.

In both cases, temperature of the solution in the reaction vessel (i.e., the aqueous solution of the water-soluble silver salt precedently charged, or for the case without such precedent charging, the solvent pre-charged in the reaction vessel as described later) is preferably 5 to 75° C., more preferably 5 to 60° C., and most preferably 10 to 50° C. While the temperature is preferably be controlled over the entire process of the reaction at a certain temperature selected from the above range, it is also allowable to control the temperature within the above range according to several temperature patterns.

Temperature difference between the aqueous tertiary alcohol solution containing the alkali metal salt of the organic acid and the solution in the reaction vessel is preferably within a range from 20 to 85° C., and more preferably from 30 to 80° C. In this case, the aqueous tertiary alcohol solution containing the alkali metal salt of the organic acid preferably has a higher temperature.

Based on such temperature definition, deposition rate of microcrystalline alkali metal salt of the organic acid from the aqueous tertiary alcohol solution upon rapid cooling in the reaction vessel and production rate of the organic silver salt through reaction with the water-soluble silver salt are properly controlled thereby to properly control crystal form, crystal size and crystal size distribution of the organic silver salt, which concomitantly result in improved properties as a photothermographic material, and in particular as a photothermographic material.

The reaction vessel can be pre- charged with a solvent. While the pre-charged solvent is preferably water, a mixed solvent thereof with the tertiary alcohol is also allowable.

A dispersion aid soluble to water-base medium may be added to the aqueous tertiary alcohol solution of the alkali metal salt of the organic acid, aqueous solution of the water-soluble silver salt or the reaction solution. The dispersion aid may be of any type provided that it can disperse the produced organic acid silver salt. Specific examples thereof complies with the description later of the dispersion aid for the organic acid silver salt.

In a process of producing the organic acid silver salt in the present invention, it is preferable to provide a desalting and dewatering step after the production of the silver salt. There is no specific limitation on the method therefor, and any of well-known practical means is applicable. Known filtration methods such as centrifugal filtration, suction filtration, ultrafiltration and flocculation washing based on coagulation; and supernatant removal after centrifugal separating sedimentation are preferably used. The desalting and dewatering may be effected once or repeated plural times. Addition and removal of water may be effected continuously or independently. The desalting and dewatering is effected so as to preferably obtain a conductivity of the finally recovered water of approx. 300 $\mu$S/cm or lower, more preferably 100 $\mu$S/cm or lower, and most preferably 60 $\mu$S/cm or lower. While the lower limit of the conductivity is not; specifically limited, it is 5 $\mu$S/cm or around in general.

To obtain desirable properties of the coated surface of the photothermographic material, in particular of the photothermo-graphic material, it is preferable to first prepare a water-base dispersion of the organic acid silver salt, convert it into a high-speed flow under a high pressure, drop the pressure thereof to effect re-dispersion, thereby to obtain a fine water-base dispersion. Although the dispersion medium in this case preferably consists of water only, the medium may contain organic solvent within a content of 20 wt %.

The organic acid silver salt can mechanically be dispersed in a form of fine grains in the presence of a dispersion aid using a known pulverizing means (e.g., high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill).

It is preferable that the dispersion is effected in the absence of the photosensitive silver salt, since presence of the photosensitive silver salt during the dispersion may increase fog and significantly lower the sensitivity. In the present invention, a content of the photosensitive silver salt in the water-base dispersion to be dispersed is 0.1 mol % or less per mol of the organic acid silver salt contained therein, without any intentional addition of the photosensitive silver salt.

To obtain a solid dispersion of the organic silver salt with a high S/N ratio, small grain size and no coagulation, it is preferable in the present invention to apply a large force to the grains of the organic silver salt as an image forming medium within a range such that causing no fracture or excessive temperature rise of the grains. Thus preferable is a dispersion method such that converting a water-base dispersion comprising the organic silver salt and aqueous dispersion aid solution into a high-speed flow, and then dropping the pressure thereof.

Solid dispersion apparatuses and technologies available for implementing the above re-dispersion in the present invention are detailed, for example, in"Bunsankei Reoroji to Bunsanka Gijutsu (Dispersed System Rheology and Dispersion Technology)", by Toshio Kajiuchi and Hiroki Usui, 1991, issued by Sinzansha Shuppan, p.357–403; "Kagaku Kogaku no Sinpo (Advances in Chemical Engineering) Vol.24", ed. Tokai Section, The Society of Chemical Engineers, 1990, issued by Maki Shoten, p.1841-185; JP-A-59-49832; U.S. Pat. No. 4,533,254; JP-A-8-137044; JP-A-8-238848; JP-A-2-261525; and JP-A-1-94933. A dispersion method employed in the present invention is such that feeding the water-base dispersion containing at least organic silver salt into a piping while being pressurized with a high-pressure pump or the like, allowing the dispersion to pass through a narrow slit, and then causing an abrupt pressure drop of the dispersion thereby to complete a fine dispersion.

As for a high-pressure homogenizer available in the present invention, an uniform and effective dispersion is generally considered to be effected, without altering neither (a)"shearing force" generated when dispersoid passes through a narrow gap (approx. 75 to 350 $\mu$m) under a high pressure and at a high speed, nor (b)"cavitation force" generated by liquid-liquid collision or collision against a wall in a pressurized narrow space, by enhancing the cavitation force by the succeeding pressure drop. Galling homogenizer has long been known as such kind of dispersion apparatus, in which a pressure-fed solution to be dispersed is converted into a high-speed flow at a narrow gap on a cylinder surface, then rushed to be collided with the peripheral wall, thereby allowing emulsification or dispersion assisted by the impact force. The liquid-liquid collision can be effected, for example, in a Y-type chamber of a microfluidizer and a spherical chamber using a ball type check valve as disclosed in JP-A-8-103642 described later, and the liquid-wall collision can be effected, for example, in a Z-type chamber of a microfluidizer. Operating pressure is, in general, selected in a range from 100 to 600 kg/cm$^2$, and a flow rate is in a range from several to 30 m/second. There is also proposed an apparatus such that having a sawtoothed high flow rate portion to increase the number of collision for a higher dispersion efficiency. Typical examples of such apparatuses include galling homogenizer, microfluidizer manufactured by Microfluidex International Corporation or Mizuho Kogyo K. K., and Nanomizer manufactured by Tokushu Kika Kogyo Co., Ltd. Such apparatuses are also disclosed in JP-A-8-238848, JP-A-8-103642 and U.S. Pat. No. 4,533,254.

The organic silver salt can be dispersed so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3,000 kg/cm$^2$, and more preferably from 1,500 to 3,000 kg/cm$^2$. The number of repetition of the process is selectable as required. While this is generally selected as once to as much as 10 times, preferable in view of productivity is from once to 3 times. Raising the temperature of such water dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop, to maintain the temperature of the water dispersion within a range from 5 to 90° C., more preferably from 5 to 80° C., and still more preferably 5 to 65° C. Providing such cooling step is exceptionally effective when the dispersion is proceeded under the pressure as high as 1,500 to 3,000 kg/cm$^2$. A cooler is properly selected, depending on the required capacity of heat exchange, from those being equipped with a double pipe or triple pipe as combined with a static mixer; shell-and-tube heat exchanger; and coiled heat exchanger. The diameter, wall thickness and material of the pipe may properly be selected, considering the operating pressure, so as to improve the efficiency of the heat exchange. Coolants available for the cooler include well water at 20° C.; cold water at 5 to 10° C. fed from a chiller; and, as requested, ethylene glycol/water at −30° C.

When the organic acid silver salt is dispersed in a form of solid micrograms using a dispersion aid, the dispersion aid can be properly selected from., for example, synthetic anionic polymers such as polyacrylic acid, acrylic acid copolymers, maleic acid copolymers, maleic acid monoester copolymers and acryloylmethylpropanesulfonic acid copolymers; semisynthetic anionic polymers such as carboxymethylated starch and carboxymethylcellulose; anionic polymers such as alginic acid and pectic acid; anionic surfactant disclosed in JP-A-52-92716 and International Pat. Publication WO88/04794; a compound disclosed in JP-A-9-179243; and known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like.

The dispersion aid is generally mixed with the organic silver salt in a form of powder or wet cake before the dispersing operation, and fed as slurry into a dispersion apparatus, whereas the dispersion aid may also be included in the powder or wet cake by heat treatment or solvent treatment of the dispersion aid premixed with the organic silver salt. The pH may be controlled with a suitable pH adjusting agent during, before or after the dispersing operation.

Besides such mechanical dispersing operation, the organic silver salt can preliminarily be dispersed into solvent by pH control, and then can thoroughly be dispersed by altering pH under the presence of the dispersion aid. The solvent for the preliminary dispersion may be an organic solvent, which is generally removed after the thorough dispersion.

The produced dispersion can be stored under stirring in order to prevent precipitation of the micrograms during storage, or stored in a highly viscous :state by producing hydrophilic colloid (e.g., jelly state formed with gelatin). Further, it may be added with a preservative in order to prevent germ proliferation during the storage. The organic acid silver salt obtained by such preparation method is preferably dispersed in water-base solvent, mixed with an aqueous solution of a photosensitive silver salt and provided as a coating liquid for a photosensitive image producing medium, Prior or to the dispersion process, the source liquid is roughly dispersed (preliminary dispersion). Known dispersion means (e.g., high-speed mixer, homogenizer, high-speed impact mill, banbury mixer, homomixer, kneader, ball mill, vibration ball mill, epicyclic ball mill, attritor, sand mill, bead mill, colloid mill, jet mill, roller mill, trommel and high-speed stone mill) is adoptable to the preliminary dispersion. Besides such mechanical dispersing operation, the organic silver salt can preliminarily be dispersed into solvent by pH control, and then can thoroughly be dispersed by altering pH under the presence of the dispersion aid. The solvent for the preliminary dispersion may be an organic solvent, which is generally removed after the thorough dispersion.

The aqueous solution of the photosensitive silver salt is mixed after being finely dispersed to provide a coating liquid for a photosensitive image producing medium. Using such coating liquid ensures a photothermographic material with a low haze, low fog and high sensitivity. On the contrary, presence of the photosensitive silver salt at the time of dispersion through the conversion into high-pressure, high-speed flow tends to result in increased fog and significantly lowered sensitivity. Using organic solvent, in place of water, also tends to raise the haze, increase the fog and lower the sensitivity. In place of mixing the aqueous solution of the photosensitive silver salt, employing the conversion method, in which a part of the organic silver salt in the dispersion is converted into photosensitive silver salt, may lower the sensitivity.

In the above, the water-base dispersion dispersed by such conversion into a high-pressure, high-speed flow substantially contains no photosensitive silver salt, where the content thereof, if present, is 0.1 mol, or less of the non-photosensitive organic silver salt contained therein, which is not a result of intentional addition.

Grain size (volume weighted mean diameter) of the solid microgram dispersion of the organic silver salt can be measured by, for example, irradiating laser light to the solid microgram dispersion in a liquid state and deriving an autocorrelation function with respect to the time-dependent fluctuation in the scattered light intensity. An average grain size of the solid microgram dispersion is preferably within a range from 0.05 to 10.0 $\mu$m, more preferably 0.1 to 5.0 $\mu$m, and still more preferably 0.1 to 2.0 $\mu$m.

The solid micrograin dispersion of the organic silver salt preferably used in the present invention comprises at least an organic silver salt and water. While there is no specific limitation on the ratio of the organic silver salt and water, the organic silver salt preferably accounts for 5 to 50 wt % of the total weight of the dispersion, and more preferably 10 to 30 wt %. Using a dispersion aid described previously is preferable provided that it is used in a minimum amount within a range suitable for minimizing the grain size, and preferable range thereof is 1 to 30 wt % of the organic silver salt, and more preferably 3 to 15 wt %.

In the present: invention, the photosensitive material can be prepared by mixing the water-base dispersion of the organic silver salt and the water-base dispersion of the photosensitive silver salt. Ratio of mixing of the organic silver salt and the photosensitive silver salt is selectable depending on purposes, while preferable range of the photosensitive silver salt relative to the organic silver salt is 1 to 30 mol %, more preferably 3 to 20 mol %, and still more preferably 5 to 15 mol %. Mixing two or more kinds of water-base dispersions of the organic salts and two or more kinds of water-base dispersions of the photosensitive silver salts is a preferable method for controlling photographic properties.

The organic silver salt can be used in a desired amount, where 0.1 to 5 g/m$^2$ as an amount of silver is preferable and 1 to 3 g/m$^2$is more preferable.

The photosensitive silver halide used in the present invention has no specific limitation in the halogen composition thereof, and any of silver chloride, silver chlorobromide, silver bromide, silver iodobromide and silver iodochlorobromide is available. The halogen composition distribution within the grain may be uniform, or the halogen composition may vary stepwise or continuously. Silver halide grain with a core/shell structure may preferably be used, in which the structure is preferably of two- to five-fold, and more preferably of two- to four-fold. It is also preferable to adopt a technique for localizing silver bromide on the surface of silver chloride or silver cholorobromide.

Methods for producing photosensitive silver halide used in the present invention are! well known in the art, and, for example, the methods described in *Research Disclosure,* No. 17029 (June, 1978) and U.S. Pat. No. 3,700,458 may be applied. The method applicable to the present invention includes such that adding a halogen-containing compound to the prepared organic silver salt to convert a part of silver contained therein into photosensitive silver halide, and such that adding a silver source compound and a halogen source compound to gelatin or other polymer solution thereby to prepare photosensitive silver halide grains, which are then mixed with an organic silver salt.

The photosensitive silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means a diameter of a sphere having a volume equivalent to that of a silver halide grain for the case that the silver halide grain is a normal crystal having cubic or octahedral shape or the grain is an abnormal crystal having spherical or rod shape; whereas it means a diameter of a circle image having an area equal to the projected area of the major plane of the silver halide grain for the case that the grain shape is tabular.

Examples of the shape of the silver halide grain include cubic, octahedral, tabular, spherical, rod and pebble; among these, cubic being preferred in the present invention. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye accounts for a large percentage. The percentage is preferably 50% or above, more preferably 65% or above, still more preferably 80% or above. The percentage of a plane with a Miller index of [100] can be determined by the method described in T. Tani, *J. Imaging Sci.,* 29, 165 (1985), which is based on the plane dependency of adsorption of the sensitizing dye between [111] and [100] planes.

The photosensitive silver halide grain contains a metal of Groups VIII to X in the Periodic Table (showing Groups I to XVIII), or complexes thereof. Such metal or a center metal of the metal complex is preferably rhodium, rhenium, ruthenium, osmium or iridium. These metals or metal complexes may be used individually, and two or more metal complexes having the same metal or different metals may be used in combination. Content of the metal or metal complex is preferably from $1\times10^{-9}$ to $1\times10^{-3}$ mol per mol of silver in the silver halide. Such metal complexes are described in the paragraphs [0018] to [0024] of JP-A-11-65021.

Among these, iridium is preferably contained in the silver halide grain in the present invention. Specific examples of the iridium compound include hexachloroiridium, hexammineiridium, trioxalatoiridium, hexacyanoiridium and pentachloronitrosyliridium. These iridium compounds are used in a dissolved form in water or other appropriate solvent. It is also allowable to add an aqueous hydrogen halide solution (e.g., hydrochloric acid, bromic acid, fluoric acid) or alkali halide (e.g., KCl, NaCl, KBr, NaBr), which are the common methods for stabilizing the solution of the iridium compound. Or the silver halide can also be prepared by adding and dissolving a separate silver halide grain pre-doped with iridium. Amount of addition of the iridium compound is preferably from $1\times10^{-8}$ to $1\times10^{-3}$ mol per one mol of silver halide, and more preferably from $1\times10^{-3}$ to $5\times10^{-4}$ mol/mol Ag.

As for metal complexes (for example, $[Fe(CN)_6]^{4-}$) possibly contained in the silver halide grains for use in the present invention, applicable methods for desalting or chemical sensitization are disclosed in the paragraphs [0046] to [0050] of JP-A-11-84574, and the paragraphs [0025] to [0031] of JP-A-11-65021.

The sensitizing dye may advantageously be selected from those capable of spectrally sensitizing the silver halide grains in a desired wavelength region by adhering thereon, and having a spectral sensitivity suitable for spectral characteristics of an exposure light source. Sensitizing dyes and methods for adding thereof are described in the paragraphs [0103] to [0109] of JP-A-11-65021, expressed by the formula (II) of JP-A-10-186572, and described from line 38 on page 19 to line 35 on page 20 of European Laid-Open Pat. Publication No. 0803764A1. The sensitizing dye is added into the silver halide emulsion preferably in a period from the completion of the desalting to the start of the coating, and more preferably from the desalting to the start of the chemical ripening.

In the present invention, the photosensitive silver halide grains are preferably subjected to chemical sensitization by the sulfur sensitization, selenium sensitization or tellurium sensitization. Preferable compounds preferably used for the sulfur, selenium or tellurium sensitization are found in, for example, JP-A-7-128768. Particularly preferable in the present invention is the tellurium sensitization, and examples of the tellurium sensitizer include diacyl tellurides, bis(oxycarbonyl) tellurides, bis(carbamoyl) tellurides, diacyl ditellurides, bis(oxycarbonyl) ditellurides, bis(carbamoyl) ditellurides, compounds having a P=Te bond, tellurocarboxylates, tellurosulfonates, compounds having a P=Te bond and tellurocarbonyl compounds. Specific examples thereof relate to the compounds disclosed in the paragraph [0030] of JP-A-11-65021. The compounds expressed by formulae (II), (III) and (IV) of JP-A-5-313284 are particularly preferred.

In the present invention, the chemical sensitization may come into effect at any timing provided that it is after the grain production and before the coating, and it may be effected after the desalting and (1) before the spectral sensitization, (2) simultaneously with the spectral sensitization, (3) after the spectral sensitization, and (4) immediately before the coating. It is in particular preferable to perform it after :he spectral sensitization.

The amount of the sulfur, selenium or tellurium sensitizer used in the present invention varies depending on silver halide grains used or chemical ripening conditions. However, it is generally from $10^{-8}$ to $10^{-2}$ mol per mol of silver halide, preferably on the order of from $10^{-7}$ to $10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 44 to 70° C..

In the photosensitive material used for the present invention, a single kind of silver halide emulsion may be used, or two or more kinds of silver halide emulsions (for example, those differ in the average grain size, halogen composition, crystal habit or chemical sensitization conditions) may be used in combination. Using a two or more kinds of photosensitive silver halides differ in sensitivity allows gradation control. Related technologies are disclosed, for example, in JP-A-57-119341, JP-A-53-106125, JP-A-47-3929, JP-A-48-55730, JP-A-46-5187, JP-A-50-73627 and JP-A-57-150841. Sensitivity difference among individual emulsions is preferably 0.2logE each or larger.

Content of silver halide as expressed in a coated amount of silver per 1 $m^2$ of the photosensitive material is preferably 0.03 to 0.6 $g/m^2$, more preferably 0.05 to 0.4 $g/m^2$, and still more preferably 0.1 to 0.4 $g/m^2$. The amount of the photosensitive silver halide used in the present invention is preferably from 0.01 to 0.5 mol per mol of the organic silver salt, more preferably from 0.02 to 0.3 mol, still more preferably from 0.03 to 0.25 mol.

Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any timing during the preparation of the organic silver salt, already-finished photosensitive silver halide to prepare the organic silver salt; while being not limited thereto so long as sufficient effects of the present invention are obtained.

A preferable timing for adding the silver halide to the coating liquid for the image producing layer resides in a period from 180 minutes before to immediately before the coating, and more preferably from 60 minutes before to 10 seconds before. There is no specific limitation on method or conditions for the mixing provided that sufficient effects of the present invention will be obtained. Specific examples of the method include such that using a tank devised so that an average retention time estimated based on the addition flow rate and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

In the present invention, preferable photothermographic material can be produced when the organic silver salt-containing layer is formed by coating and drying a coating liquid, in which water accounts for 30 wt % or above of the solvent thereof, and when a binder in the organic silver salt-containing layer comprises a polymer latex which is soluble or dispersible in a water-base solvent and in particular has an equilibrium moisture content of 2 wt % or below at 25° C. and relative humidity of 60%. A most preferable embodiment relates to the polymer latex prepared so as to have an ion conductivity of 2.5 mS/cm or below. Such polymer latex can be obtained by purifying a synthesized polymer using a separation functional membrane.

A water-base solvent capable of dispersing the polymer latex refers to water or water mixed with 70 wt % or less thereof of a water-miscible organic solvent. Examples of the water-miscible solvent include alcohols such as methanol, ethanol and propanol; Cellosolves such as Methyl Cellosolve, Ethyl Cellosolve and Butyl Cellosolve; ethyl acetate and dimethylformamide.

The term "water-base solvent" is now also used herein to express a system in which polymer is not solubilized in a thermodynamic sense but exists in a dispersed form.

"The equilibrium moisture content at 25° C., 60%RH" is expressed by an equation such as $$\text{equilibrium moisture content at } 25^\circ\text{ C., } 60\%\text{RH} = [(w1 - W0)/W0] \times 100(\text{wt }\%)$$

where, W1 represents polymer weight under humidity conditioning equilibrium in an environment of 25° C. and 60%RH, and WO represents polymer weight under bone dry equilibrium. Definition and measurement method of water content can be referred to the description of "Kobunshi Zairyo Shiken-ho (Test Methods for Polymer Materials)" in the series of "Kobunshi Kogaku Koza 14 (Polymer Engineering Course 14)", edited by Polymer Society, published by Chijin Shokan.

An equilibrium moisture content at 25° C., 60%RH of the binder polymer used in the present invention is preferably 2 wt % or less, more preferably 0.01 to 1.5 wt %, and still more preferably 0.02 to 1 wt %.

Quite preferable in the present invention is a polymer dispersible in the water-base solvent.

Possible dispersion forms include such that micrograms of solid polymer are dispersed to form a latex, and such that polymer molecules are dispersed in a molecular state or form micells, either of which being preferable.

In a preferred embodiment of the present invention, preferably used are hydrophobic polymers such as acrylic resin, polyester resin, rubber-base resin (for example, SBR resin), polyurethane resin, vinyl chloride resin, vinyl acetate resin, vinylidene chloride resin and polyolefin resin. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 200,000. Too small molecular weight will result in poor mechanical strength of the emulsion layer, whereas too large in undesirable film-forming property.

The "water-base solvent" refers to a dispersion medium such that 30 wt % of the composition of which being composed of water. Any style of dispersion, such as emulsified dispersion, micellar dispersion, or molecular dispersion of polymer having in the molecule a hydrophilic portion, is allowable, and most preferable style can be found in latex.

Preferable examples of the polymer latex are listed below, in which polymers are expressed with source monomers, and numerals in the parentheses denote contents in wt % and the molecular weights represent number average molecular weights:

P-1; latex expressed as -MMA(70)-EA(27)-MAA(3)-(M.W. 37,000)

P-2; latex expressed as -MMA(70)-2EHA(20)-St(5)-AA(5)-(M.W. 40,000)

P-3; latex expressed as -St(50)-Bu(47)-MAA(3)-(M.W. 45,000)

P-4; latex expressed as -St(68)-Bu(29)-AA(3)-(M.W. 60,000)

P-5; latex expressed as -St(70)-Bu(27)-IA(3)-(M.W. 120,000)

P-6; latex expressed as -St(75)-Bu(24)-AA(1)-(M.W. 108,000)

P-7; latex expressed as -St(60)-Bu(35)-DVB(3)-MAA(2)-(M.W. 150,000)

P-8; latex expressed as -St(70)-Bu(25)-DVB(2)-AA(3)-(M.W. 280,000)

P-9; latex expressed as -VC(50)-MMA(20)-EA(20)-AN(5)-AA(5)-(M.W. 80,000)

P-10; latex expressed as -VDC(85)-MMA(5)-EA(5)-MAA(5)-(M.W. 67,000)

P-11; latex expressed as -Et(90)-MAA(10)-(M.W. 12,000)

P-12; latex expressed as -St(70)-2EHA(27)-AA(3)-(M.W. 130,000)

P-13; latex expressed as -MMA(63)-EA(35)-AA(2)-(M.W. 33,000)

The abbreviations in the above structures correspond with monomers as follows: MMA=methyl methacrylate, EA=ethyl acrylate, MAA=methacrylic acid, 2EHA=2-ethylhexyl acrylate, St=styrene, Bu=butadiene, AA=acrylic acid, DVB=divinylbenzene, VC=vinyl chloide, AN=acrylonitrile, VDC=vinylidene chloride, Et=ethylene, and IA=itaconic acid.

Such polymers are also commercially available, which include acrylic resins such as CEBIAN A-4635, 46583 and 4601 (all produced by Dicel Kagaku Kogyo K.K.) and Nipol Lx811, 814, 821, 820, 857 (all produced by Nippon Zeon K.K.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP 10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon K.K.); vinyl chloride resins such as G351, G576 (both produced by Nippon Zeon K.K.); vinylidene chloride resins such as L502, L513 (both produced by Asahi Chemical Industry Co., Ltd.); and olefin resins such as CHEMIPEARL S120 and SA100 (both produced by Mitsui Chemical Co., Ltd.).

These polymers may be used individually or, as required, as a blend of two or more thereof.

A latex of styrene-butadiene copolymer is in particular preferable as the polymer latex used in the present invention. A weight ratio of styrene monomer unit and butadiene monomer unit in the styrene-butadiene copolymer is preferably 40:60 to 95:5. The styrene monomer unit and butadiene monomer unit preferably account for 60 to 99 wt % of the copolymer. A preferable range for the molecular weight thereof is the same as described previously.

The latex of the styrene-butadiene copolymer preferably used in the present invention is typified as P-3 to P-8 listed above and commercially available LACSTAR-3307B, 7132C, and Nipol Lx416.

To the organic silver salt-containing layer, it is allowable to add, as required, hydrophilic polymer such as gelatin, polyvinyl alcohol, methylcellulose and hydroxypropylcellulose. The amount of addition of these hydrophilic polymers is preferably 30 wt % or less of the total binder of the organic silver salt-containing layer, and more preferably 20 wt % or less.

The organic silver salt-containing layer (i.e., image producing layer) in the present invention is preferably formed using the polymer latex. A content of the binder in the organic silver salt-containing layer, expressed by a weight ratio of the total binder and the organic silver salt, is preferably 1/10 to 10/1, and more preferably 1/5 to 4/1.

Such organic silver salt-containing layer is usually a photosensitive layer (emulsion layer) containing a photosensitive silver halide as a photosensitive silver salt, and in such a case, the weight ratio of the total binder and the silver halide is preferably 400 to 5, and more preferably 200 to 10.

An amount of the total binder of the image producing layer is preferably 0.2 to 30 g/m$^2$, and more preferably 1 to 15 g/m$^2$. The image-recording layer may be added with a cross-linking agent for crosslinking or a surfactant for improving coating property.

In the present invention, the solvent (herein for simplicity, the solvent and dispersoid are inclusively termed as "solvent") is preferably a water-base solvent containing 30 wt % or more thereof of water. Possible component of the coating liquid other than water may be an arbitrary water-miscible organic solvent such as methanol, ethanol, isopropano, Methyl Cellosolve, Ethyl Cellosolve, dimethylformaide or ethyl acetate. Water content of the solvent for the coating liquid is preferably 50 wt % or above, and more preferably 70 wt % or above. Preferable examples of the solvent composition include water, water/methanol=90/10, water/methanol=70/30, water/methanol/dimethylformamide=80/15/5, water/methanol/Ethyl Cellosolve=85/10/5, and water/methanol/isopropanol=85/10/5 (the numerals are in wt %).

Appropriate examples of antifoggants, stabilizers and stabilizer precursors, available individually or in combination, include those described in paragraph [0070] of JP-A-10-62899 and from line 57 on page 20 to line 7 on page 21 of European Laid-Open Pat. Publication No. 0803764A1. The antifoggant preferably used in the present invention is organic halide, and the typical compounds are disclosed in the paragraphs [0111] to [0112] of JP-A-11-65021. In particular preferable are compounds expressed by the formula (II) as disclosed in JP-A-10-339934 (more specifically, tribromomethylnaphthylsulfone, tribromomethylphenylsulfone, and tribromomethyl[4-(2,4,6-trimethylphenylsulfonyl)phenyl]sulfone).

Methods for incorporating the antifoggant into the photosensitive material may be same as those for incorporating the heat-developing agent described above, and the organic polyhalogen compound can preferably added in a form of solid microgram dispersion.

Other possible antifoggant include a mercury (II) salt disclosed in the paragraph [0113] of JP-A-11-65021, and bezoic acids disclosed in the paragraph [0114] of the same patent publication.

The photothermographic material of the present invention may contain azolium salts for improving the sensitivity and for preventing fog. Examples of azolium salts include those expressed by the formula (XI) in JP-A-59-193447, those disclosed in JP-B-55-12581, and those expressed by the formula (II) in JP-A-60-153039. Although the azolium salts may be added to any portion of the photosensitive material, addition to a layer provided on the same side with the photosensitive layer is preferable, and to an organic-silver-salt-containing layer is more preferable. The azolium salts may be added at any step during the preparation of the coating liquid. In the case of addition to the organic-silver-salt-containing layer, they may be added at any step within a period from the preparation of the organic silver salt to the preparation of the coating liquid, where addition in a period following the preparation of the organic silver salt and immediately before the coating is preferable. The azolium salts may be added in any form of solution, powder or solid microgram dispersion. It is also allowable to add them in a form of mixed solution containing other additives such as a sensitizing dye, reducing agent and toning agent. An amount of addition of the azolium salts or benzoic acids can arbitrarily be set, where a preferable range being from $1\times10^{-6}$ to 2 mol, per mol of silver, and more preferably from $1\times10^{-3}$ to 0.5 mol.

The photothermographic material of the present invention may contain mercapto compound, disulfide compound or thione compound so as to control the development by inhibiting or accelerating thereof, to improve the spectral sensitization efficiency, or to improve the storage stability before and after the development. Such compounds are disclosed in the paragraphs [0067] to [0069] of JP-A-10-62899, expressed by the formula (I) and specifically described in the paragraphs [0033] to [0052] of JP-A-10-186572, and described in lines 36 to 56 on page 20 of European Laid-Open Pat. Publication No. 0803764A1. Among these, particularly preferable are mercapto-substituted heteroaromatic compounds.

Adding a toning agent is preferable in the present invention. Toning agents are described in the paragraphs [0054) to [0055] of JP-A-10-62899, and in lines 23 to 48 on page 21 of European Laid-Open Pat. Publication No. 0803764A1, and preferable examples of which include phthalazinone; phthalazinone derivatives or metal salts or ammonium salts thereof; derivatives such as 4-(1-naphthyl) phthalazinone, 6-chlorophthalazinone, 5,7-dimethoxyphthalazinone or 2,3-dihydro-1,4-phthalazinedione; combination of phthalazinone and phthalic acid derivatives (e.g., phthalic acid, 4-methylphthalic acid, 4-nitrophthalic acid and tetrachlorophthalic anhydride); phthalazines (e.g., phthalazine, phthalazine derivatives or metal salts, or 4-(1-naphthyl) phthalazine, 6-isopropylphthalazine, 6-t-butylphthalazine, 6-chlorophthalazine, 5,7-dimethoxyphthalazine, and 2,3-dihydrophthalazine); and combinations of phthalazine and phthalic acid derivatives (e.g., phthalic acid, 4-methylphthalic acid, 4-nitrophthalic acid tetrachlorophthalic anhydride); among which combinations of phthalazines and phthalic acid derivatives being preferable.

Plasticizer and lubricant available for the photosensitive layer are disclosed in the paragraph [0117] of JP-A-11-65021; ultrahigh contrast agents for producing a ultrahigh contrast image are disclosed in the paragraph [0118] of the same patent publication, and are expressed by the formula e (III) to (V) in Japanese Pat. Application No. 11-91652 (specifically Compounds 21 to 24); and contrast accelerators are disclosed in the paragraph (0102] of JP-A-11-65021.

The photothermographic material of the present invention may have a surface protective layer for preventing adhesion of the image producing layer. The surface protective layer is described in the paragraphs [0119] to [0120] of JP-A-11-65021.

While gelatin is preferably used as a binder for the surface protective layer, polyvinyl alcohol (PVA) is also an preferable candidate. Examples of PVA include a fully saponified PVA-105 [PVA content ≧94.0 wt %, saponification ratio=98.5±0.5 mol %, sodium acetate content ≦1.5 wt %, volatile matter content ≦5.0 wt %, viscosity (4 wt %, 20° C.)=5.6±0.4 mPa·s]; partially saponified PVA-205 [PVA content=94.0 wt %, saponification ratio=88.0±1.5 mol %, sodium acetate content=1.0 wt %, volatile matter content=5.0 wt %, viscosity (4 wt %, 20° C.)=5.0±0.4 mPa·s]; and modified polyvinyl alcohol named MP-102, MP-202, MP-203, R-1130 and R-2105 (all of which being product names by Kuraray Co., Ltd.). An amount of coating of polyvinyl alcohol (per 1 $m^2$ of the support) for the protective layer (per layer) is preferably 0.3 to 4.0 $g/m^2$, and more preferably 0.3 to 2.0 $g/m^2$.

Preparation temperature of the coating liquid for the image producing layer is preferably 30 to 65° C., more preferably 35 to 60° C., and still more preferably 35 to 55° C. It is also preferable to keep the temperature of the coating liquid for the image producing layer at 30 to 65° C. immediately after the addition of the polymer latex. The heat developing agent and the organic acid silver salt are preferably mixed with each other before the polymer latex is added.

The organic silver salt-containing fluid or the coating liquid for the image producing layer is preferably a so-called thixotropic fluid. Thixotropy refers to a property such that the viscosity decreases as the shearing velocity increases. While any type of apparatus is available for viscosity measurement, preferable measurement can be performed at 25° C. using RFS Fluid Spectrometer manufactured by Rheometric Far East Inc. In the present invention, the viscosity of the organic silver salt-containing fluid or the coating liquid for the image producing layer under a shearing velocity of 0.1 $S^{-1}$ is preferably 400 to 100,000 mpa·s, and more preferably 500 to 20,000 mpa·s. Such viscosity under a shearing velocity of 1,000 $S^{-1}$ is preferably 1 to 200 mpa·s, and more preferably 5 to 80 mpa·s.

There are known various systems exerting thixotropy and they can be found in "Koza - Reoroji (Rheology Course)" edited by Kobunshi Kanko-kai, and "Kobunshi Ratekkusu (Polymer Latex)" collaborated by Muroi and Morino. It is necessary for fluid to contain a large amount of solid micrograims for exerting thixotropy. Thixotropy can advantageously be enhanced by including a thickening linear polymer, increasing an aspect ratio of solid microgram with an anisotropic shape, or using an alkali thickener or surfactant.

The photothermographic emulsion used in the present invention forms on the support one or more layers. In the monolayer composition, the layer must contain organic silver salt, silver halide, reducing agent and binder, and may optionally contain toning agent, coating aid and other auxiliary agents as an option. In the double-layer composition, a first emulsion layer (usually adjacent to the substrate) must contain organic silver salt and silver halide, and a second layer or both layer must contain some other components. Alternative double-layer composition may be allowable in which a single emulsion layer contains all components and a protective topcoat is provided thereon. A multicolor photothermographic material may have a structure such that a combination of the above-described two layers is provided for the respective colors, or, as described in U.S. Pat. No. 4,708,928, a structure such that a single layer contains all components. In the case of a multi-dye multi-color photothermographic material, the respective emulsion layers are generally kept away from each other by using a functional or:non-functional barrier layer between the respective photosensitive layers as described in U.S. Pat. No. 4,460,681.

The photosensitive layer may contain a dye or pigment of various types so as to improve the color tone, to prevent interference fringes at the time of the laser exposure, or to prevent the irradiation. This is described in detail in WO 98/36322. Examples of dyes and pigments suitable for the photosensitive layer include anthraquinone dye, azomethine dye, indoaniline dye, azo dye, anthraquinon-base indanthrone dye (for example, C.I. Pigment Blue 60), phthalocyanine dye (for example, copper phthalocyanine such as C.I. Pigment Blue 15, and metal-free phthalocyanine such as C.I. Pigment Blue 16), dying lake pigment-base triarylcarbonyl pigment, indigo, and inorganic pigment (for example, ultramarine blue, cobalt blue). The dye may be added in any form of solution, emulsified product or solid microgram dispersion or may be added in the state mordanted with a polymer mordant. The amount of such compounds used may be determined according to desired absorbance, and, in general, the compounds are preferably used in an amount of from $1\times10^{-6}$ to 1 g per 1 $m^2$ of the recording material.

In the present invention, an antihalation layer may be provided on the side more distant from the light source than the photosensitive layer is. Description on the antihalation layer can be found in the paragraphs [0123] to [0124] of JP-A-11-65021.

It is preferable in the present invention to add a fading dye and basic precursor to the non-photosensitive layer to make it function as a filter layer or antihalation layer. The photothermographic material generally has, in addition to the image recording layer, the non-photosensitive layer. The non-photosensitive layer can be classified by the arrangement thereof into (1) a protective layer provided on the photosensitive layer (on the side more distant from the support), (2) an intermediate layer provided between a plurality of the photosensitive layers or between the photosensitive layer and the protective layer, (3) an undercoat layer provided between the photosensitive layer and the support, and (4) a back layer provided on the opposite side of the photosensitive layer. The filter layer is provided to the photosensitive material as a layer classified as (1) or (2), whereas the antihalation layer is provided thereto as a layer classified as (3) or (4).

The fading dye and basic precursor are preferably added in the same non-photosensitive layer, where adding separately into the two adjacent non-photosensitive layers is also allowable. A barrier layer can be provides between two non-photosensitive layers.

The fading dye may be added to the non-photosensitive layer in any form of solution, emulsified product or solid micrograin dispersion, or may be added by mixing polymer immersed material to the coating liquid for the non-photosensitive layer. It is also allowable to add the dye to the non-photosensitive layer using a polymer mordant. These methods of addition are the same as the general methods adding the dye to the photothermographic material. Latex used for the polymer immersed material is described in U.S. Pat. No. 4,199,363, German Laid-Open Pat. Publication Nos. 25,141,274 and 2,541,230, European Laid-Open Pat. Publication No. 029,104 and JP-B-53-41091. An emulsifying method in which the dye is added into the polymer dissolved solution is disclosed in WO 88/00723.

An amount of addition of the fading dye is determined according to the purpose of use of the dye. In general, the fading dye is used in an amount affording an optical density (absorbance) measured at a target wavelength exceeding 0.1. The optical density is preferably 0.2 to 2. An amount of use of the dye to afford such optical density is approx. 0.001 to 1 g/m$^2$ in general, more preferably approx. 0.005 to 0.8 g/m$^2$, and still more preferably approx. 0.01 to 0.2 g/m$^2$.

Such fading of the dye can make the optical density suppressed to 0.1 or below. Two or more fading dyes may be used together for the heat-fading recording material or photothermographic material. Similarly, two or more basic precursors may be used together.

The photothermographic material of the present invention is preferably of a so-called single-sided type comprising a support having on one side thereof at least one photosensitive layer containing silver halide emulsion, and on the other side thereof a back layer. In the present invention, a matting agent is preferably added to improve the conveyance property. The matting agent is described in the paragraphs [0126] to [0127] of JP-A-11-65021. A coated amount of the matting agent per 1 m$^2$ Of the photosensitive material is preferably 1 to 400 mg/m$^2$, and more preferably 5 to 300 mg/m$^2$.

While there is no particular limitation on the degree of matting so long as stardust failure does not occur, the Bekk smoothness falls preferably within a range from 30 to 2,000 seconds, and more preferably 40 to 1,500 seconds.

The degree of matting of the back layer is preferably expressed as a Bekk smoothness of 10 to 1,200 seconds, more preferably 20 to 800 seconds, and still more preferably 40 to 500 seconds.

In the present invention, the matting agent is preferably added to an outermost layer or a layer functions as the outermost layer of the photosensitive material, or to a layer provided near the outer surface thereof, and in particular to a layer functions as a so-called protective layer.

The back layer applicable to the present invention is described in the paragraphs [0128] to [0130] of JP-A-11-65021.

The individual layers including the photosensitive layer, protective layer and back layer may contain a film hardening agent. Various method of use of the film hardening agent are described in "The Theory of the Photographic Process 4th Edition" by T. H. James, published by Macmillan Publishing Co., Inc. (1977), pages 77 to 87, and preferably used are polyvalent metal ion described on page 78 of this publication; polyisocyanates described in U.S. Pat. No. 4,281,060 and JP-A-6-208193; epoxy compounds described, for example, in U.S. Pat. No. 4,791,042; and vinyl sulfone compounds described, for example, in JP-A-62-89048.

The film hardening agent is added in a form of solution, and preferable timing for adding thereof to the coating liquid for the protective layer resides in a period from 180 minutes before to immediately before the coating, and more preferably from 60 minutes before to 10 seconds before. There is no specific limitation on method or conditions for the mixing provided that sufficient effects of the present invention will be ensured. Specific examples of the method include such that using a tank devised so that an average retention time estimated based on the. flow rate during the addition and feed volume to a coater is adjusted to a desired value; and such that using a static mixer described in Chapter 8 of "Ekitai Kongo Gijutsu (Liquid Mixing Technology)" by N. Harnby, M. F. Edwards, and A. W. Nienow, translated by Koji Takahashi, published by Nikkan Kogyo Shinbun-sha (1989).

Various materials applicable to the present invention are disclosed in JP-A-11-65021, in which surfactants are disclosed in the paragraph [0132], solvents in [0133], supports in [0134], antistatic agents or conductive Layers in [0135], and methods for obtaining a color image in [0136].

The transparent support may be colored with a blue dye (for example, Dye-1 described in Example of JP-A-8-240877), or may be colorless. Undercoat techniques for the support are described in JP-A-11-84574 and JP-P-10-186565. With regard to antistatic layer or undercoating, it is also allowable to use the techniques described in JP-A-56-143430, JP-A-56-143431, JP-A-58-62646 and JP-A-56-120519.

The photothermographic material of the present invention is preferably of monosheet type (a type such that allowing forming an image thereon without using other sheets such as an image receiving material).

The photothermographic material of the present invention may be added with an antioxidant, stabilizer, plasticizer, ultraviolet absorbing agent and coating aid. These additives are added to either the photosensitive layer or non-photosensitive layer making reference to WO 98/36322, European Pat. No. 803764A1, JP-A-10-186567 and JP-A-10-18568.

The photothermographic material in the present invention may be formed by a variety of coating processes, which include extrusion coating, slide coating, curtain coating, dip coating, knife coating, flow coating, and extrusion coating using a specific hopper described in U.S. Pat. No. 2,681,294. In particular, preferable are the extrusion coating and slide coating described together in "Liquid Film Coating" by Stephen F. Kistler and Petert M. Schweizer, published by Chapman and Hall (1997), pages 399 to 536, and the slide coating being more preferable. An exemplary shape of a slide coater used for the slide coating is shown in FIG. 11.1 on page 427 in the above book. It is also allowable to simultaneously coat two or more layers as required according to the methods described on pages 399 to 536 of the above publication, U.S. Pat. No. 2,761,791 and British Pat. No. 837,095.

Techniques applicable to the present invention are also found in European Laid-Open Pat. Publication Nos. 803764A1 and 883022A1, WO 98/36322, JP-A-56-62648, JP-A-58-62644, JP-A-9-281637, JP-A-9-297367, JP-P-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to 186572, JP-A-10-197974, JP-A-10-197982, JP-A-10-197983, JP-A-10-197985 to 197987, JP-A-10-207001, JP-A-10-207004, JP-A--10-221807, JP-A-10-282601, JP-A-10-288823, JP-A-10-288824, JP-A--10-307365, JP-A-10-312038, JP-A-10-339934, JP-A-11-7100, JP-A-11-15105, JP-A-11-24200, JP-A-11-24201 and JP-A-11-30832, JP-A-.11-84574, JP-A-11-65021, JP-A-11-125880, JP-A-11-129629, JP-A--11-133536 to 133539, JP-A-11-133542 and JP-A-11-133543.

While the photothermographic material of the present invention can be developed by any method, the development is generally practiced by elevating the temperature of the photothermographic material after image-wise exposure. Preferable development temperature is 80 to 250° C., and more preferably 100 to 140° C.. Development time is preferably 1 to 180 seconds, more preferably 10 to 90 seconds, and still more preferably 10 to 40 seconds.

As for heat development system, the plate heater system is preferable. Heat development based on the plate heater system is preferably performed using an apparatus disclosed in Japanese Pat. Application No. 9-229684 or Japanese Pat. Application No. 10-177610, such that obtaining a visible image by contacting a photothermographic material, in which a latent image has been produced, with a heating means at a heat-developing section; the heating means comprising a plate heater, a pluraity of pressure rollers being opposingly placed along one plane of the plate heater, thereby allowing the photothermographic material to pass between the pressure rollers and plate heater to be heat-developed. It is preferable to section the plate heater in two to six stages, and the temperature of the endmost portion of which is set lower by 1 to 10° C. than the other portions. Such technique is disclosed also in JP-A-54-30032, and can successfully discharge the moisture and organic solvent contained in the photothermographic material out of the system, and can prevent deformation of the support of the photothermographic material due to an abrupt heating thereof.

The photosensitive material of the present invention may be light-exposed by any method but the light source for the exposure is preferably a laser light. The laser light for use in the present invention is preferably one from a gas laser ($Ar^+$, He—Ne), YAG laser, dye laser, semiconductor laser or the like. The semiconductor laser as combined with a second harmonic generation device may also be used. Preferable is a gas or semiconductor laser emitting red to infrared light.

While a single-mode laser is available as a laser light, where a technique disclosed in the paragraph [0140] of JP-A-11-65021 is applicable.

Laser output is preferably 1 mW or above, more preferably 10 mW or above, and still more preferably as high as 40 mW or above. A plurality of laser beams can be superposed. Beam spot diameter can be approx. 30 to 200 $\mu$m as expressed by an $i/e^2$ spot size of a Gaussian beam.

A laser imager equipped with an exposure section and a heat developing section can be typified by Fuji Particular Dry Imager FM-DPL.

The photothermographic material of the present invention preferably forms a black-and-white image based on silver image and is preferably used for photothermographic materials for particular diagnosis, industrial photograph, printing and COM. Obtained black-and-white image can, of course, be used for producing a duplicated image on duplication film MI-Dup manufactured by Fuji Photo Film Co., Ltd. for particular diagnosis, and used for printing as a mask for forming an image on films for return DO-175 and PDO-100 manufactured by Fuji Photo Film Co., Ltd. or on an offset printing plate.

EXAMPLES

The present intention will be explained in more detail with reference to the following examples. Now, the materials, reagents, ratio, operation and so forth described hereinafter may properly be modified without departing from the spirit of the present invention. The scope of the present invention, therefore, is by no means limited to specific embodiments described below.

Fabrication of PET Support

PET with an intrinsic viscosity (IV) of 0.66 (measured in phenol/tetrachloroethane=6/4 (ratio by weight) at 25° C.) was obtained by the general procedures using terephthalic acid and ethylene glycol. The obtained PET was pelletized, dried at 130° C. for 4 hours, melted at 300° C., extruded from a T-die and rapidly cooled, to obtain a unstretched film so as to have a thickness after heat setting of 175 $\mu$m.

The film was then longitudinally stretched 3.3 times at 110° C. using rollers different in the peripheral speed and then transversely stretched 4.5 times at 130° C. using a tenter. Subsequently, the film was heat-set at 240° C. for 20 seconds, and then relaxed by 4% in the transverse direction at the same temperature. Thereafter, a portion chucked by the tenter was slit off and the film was knurled at the both edges and then taken up. Thus, a rolled support of 175 $\mu$m thick was fabricated.

Surface Corona Treatment

Using a solid state corona treatment apparatus (6-kVA model, product of Pillar Corporation), the both planes of the support were treated at 20 m/min under the room temperature. Referring to read values of current and voltage, it was confirmed that the support was treated at 0.375 kVA·minute/$m^2$. The treatment frequency was 9.6 kHz and the gap clearance between the electrode and dielectric roll was 1.6 mm.

Preparation of Coating Liquid for Undercoat Layer on the Photosensitive Layer Side

| | |
|---|---|
| PESRESIN A-515GB (30 wt% solution, manufactured by Takamatsu Oil & Fat Co., Ltd.) | 234 g |
| polyethylene glycol monononylphenyl ether (average number of ethylene oxide = 8.5), 10 wt % solution | 21.5 g |
| MP-1000 | 0.91 g |

-continued

| | |
|---|---|
| (polymer micrograin, average grain size = 0.4 μm, manufactured by Soken Chemical & Engineering Co., Ltd.) | |
| distilled water | 744 ml |

Preparation of Coating Liquid for First Layer on the Back Plane

| | |
|---|---|
| butadiene-styrene copolymer latex (solid content = 40 wt %, ratio by weight of butadiene/styrene = 32/68) | 158 g |
| 2,4-dichloro-6-hydroxy-S-triazine sodium salt (8 wt % aqueous solution) | 20 g |
| sodium laurylbenzenesulfonate (1 wt % aqueous solution) | 10 ml |
| distilled water | 854 ml |

Preparation of Coating Liquid for Second Layer on the Back Plane

| | |
|---|---|
| $SnO_2$/SbO (ratio by weight = 9/1, average grain size = 0.038 μm, 17 wt % dispersion) | 84 g |
| gelatin (10% aqueous solution) | 89.2 g |
| METHOLLOSE TC-5 (2% aqueous solution, Manufactured by Shin-Etsu Chemical Co., Ltd.) | 8.6 g |
| MP-1000 (polymer micrograin, manufactured by Soken Chemical & Engineering Co., Ltd.) | 0.01 g |
| Sodium dodecylbenzenesulfonate (1 wt % aqueous solution) | 10 ml |
| NaOH (1%) | 6 ml |
| PROXEL (manufactured by ICI Corporation) | 1 ml |
| distilled water | 805 ml |

Preparation of Undercoated Support

Both sides of the biaxially stretched polyethylene terephthalate film of 175 μm thick were individually subjected to the corona discharge treatment, the coating liquid for the undercoat layer on the photosensitive layer side was then coated using a wire bar in a wet coated amount of 6.6 ml/$m^2$ on one plane (photosensitive layer side) and was allowed to dry at 180° C. for 5 minutes. The coating liquid for the first layer on the back plane was then coated using a wire bar in a wet coated amount of 5.7 ml/$m^2$ on the rear plane (back plane) and was allowed to dry at 180° C. for 5 minutes, and the coating liquid for the second layer on the back plane was further coated thereon using a wire bar in a wet coated amount of 7.7 ml/$m^2$ and was allowed to dry at 180° C. for 6 minutes, thereby to obtain an undercoated support.

Preparation of Solid Micrograin Dispersion (a) of Basic Precursor

Sixty-four grains of Basic Precursor Compound 11, 28 g of diphenylsulfone, 10 g of DEMOL-N (surfactant manufactured by KAO Corporation), and 220 ml of distilled water were mixed, and the mixture was bead-dispersed using a sand mill (1/4-gallon Sand Grinder Mill, manufactured by AIMEX Corporation), thereby to obtain a solid microgram dispersion (a) of the basic precursor compound with an average grain size or 0.2 μm.

Preparation of Solid Micrograin Dispersion of Dye

To 305 ml of distilled water, added were 9.6 g of the Cyanine Dye Compound 13 and 5.8 g of sodium p-dodecylbenzenesulfonate, and the mixture was then bead-dispersed using a sand mill (¼-gallon Sand Grinder Mill manufactured by AIMEX Corporation), thereby to obtain a solid micrograin dispersion of the dye with an average grain size or 0.2 μm.

((Preparation of Coating Liquid for Antihalation Layer

Seventeen grams of gelatin, 9.6 g of polyacrylamide, 70 g of the above-described solid microgram dispersion (a) of the basic precursor, 56 g of the above-described solid microgram dispersion of the dye, 1.5 g of polymethyl methacrylate microgram (average grain size=6.5 μm), 0.03 g of benzoisothiazolinone, 2.2 g of sodium polyethylenesulfonate, 0.2 g of Blue Dye Compound 14 and 844 ml of water were mixed to prepare a coating liquid for the antihalation layer.

Preparation of Coating Liquid for Protective Layer on the Back Plane

While keeping the temperature of a vessel at 40° C., 50 g of gelatin, 0.2 g of sodium polystyrenesulfonate, 2.4 g of N,N-ethyl-enebis(vinyl sulfoneacetamide), 1 g of sodium t-octylphenoxy-ethoxyethanesulfonate, 30 mg of benzoisothiazolinone, 37 mg of N-perfluorooctylsulfonyl-N-propylalanine potassium salt, 0.15 g of polyethyleneglycol mono(N-perfluorooctylsulfonyl-N-propyl-2-aminoethyl)ether average degree of polymerization of ethylene oxide =15), 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization ratio by weight=5/95), 0.6 g of Aerosol OT (American Cyanamide Corporation), liquid paraffin emulsion in an amount of 1.8 g as the liquid paraffin, and 950 ml of water were mixed, thereby to obtain a coating liquid for the protective layer on the back plane.

Preparation of Silver Halide Grain 1

To 1,421 ml of water, added were 8.0 ml of an 1 wt % potassium bromide solution, 8.2 ml of an 1 N nitric acid and 20 g of phthalized gelatin, the mixture was kept stirred in a titanium-coated stainless reaction vessel at a constant liquid temperature of 37° C., and was then added with an entire volume of solution "A" obtained by dissolving 37.04 g of silver nitrate in distilled water and diluting it up to 159 ml, by the controlled double jet method at a constant flow rate over 1 minute while keeping pAg at 8.1. Solution "B" obtained by dissolving 32.6 g of potassium bromide in water and diluting it up to 200 ml was also added by the controlled double jet method. After that 30 ml of a 3.5 wt % aqueous hydrogen peroxide solution was added, and 36 ml of a 3 wt % aqueous solution of benzoimidazole was further added. Solution "A" was further diluted with distilled water to 317.5 ml to obtain solution "A2", and solution "B" was further added with tripotassium hexachloroiridate so as to attain a final concentration thereof of $1\times10^{-4}$ mol/mol Ag and diluted with distilled water up to doubled volume of 400 ml to obtain solution "B2". Again an entire volume of solution "A2" was added to the mixture by the controlled double jet method at a constant flow rate over 10 minute while keeping pAg at 8.1. Solution "B2" was also added by the controlled double jet method. After that, the mixture was added with 50 ml of a 0.5 wt % methanol solution of 5-methyl-2-mercaptobenzoimidazole, the pAg of which was raised to 7.5 with silver nitrate, the pH of which was then adjusted to 3.8 with an 1 N sulfuric acid, stopped stirring, subjected to precipitation/desalting/washing processes, added with 3.5 g of deionized gelatin, the pH and pAg of which were adjusted to 6.0 and 8.2, respectively, with an 1 N sodium hydroxide, thereby to obtain a silver halide emulsion.

Grain in the resultant silver halide emulsion was found to be a pure silver bromide grain with an average sphere-equivalent diameter of 0.053 μm and a sphere-equivalent coefficient of variation of 18%. Grain size and so forth were determined based on an average diameter of 1,000 grains under electron microscopic observation. Ratio of [100] plane of such grain was determined as 85% based on the method of Kubelka-Munk.

The above emulsion was kept at 380° C. under stirring, 0.035 g of benzoisothiazolinone was added (in a form of a 3.5 wt % methanol solution) thereto, a solid dispersion of Spectral Sensitizing Dye "A" (aqueous gelatin solution) was added thereto 40 minutes after in an amount of $5\times10^{-3}$ mol/mol Ag, the temperature thereof was raised to 47° C. one minute after, sodium benzenethiosulfonate was added thereto 20 minutes after in an amount of $3\times10^{-5}$ mol/mol Ag, Tellurium Sensitizer "B" was added thereto 2 minutes after in an amount of $5\times10^{-5}$ mol/mol Ag, and was then ripened for 90 minutes. Immediately before completion of the ripening, 5 ml of a 0.5 wt % methanol solution of N,N'-dihydroxy-N-diethylmelamine was added, temperature of which was lowered to 31° C., and 5 ml of a 3.5 wt % methanol solution of phenoxy ethanol, $7\times10^{-3}$ mol/mol Ag of 5-methyl-2-mercaptobenzoimidazole, and $6.4\times10^{-3}$ mol/mol Ag of 1-phenyl-2-heptyl-5-mercapto-1,3,4-triazole were added, thereby to obtain a silver halide emulsion 1.

Preparation of Silver Halide Grain 2

An emulsion containing pure cubic silver bromide grain with an average sphere-equivalent diameter of 0.08 μm and a sphere-equivalent coefficient of variation of 15% was prepared similarly to the preparation of silver. halide emulsion 1 except that the temperature of the mixed solution during grain formation was raised to 50 ° C. , in place of 37° C., Precipitation/desalting/washing/dispersion were performed similarly to those in the case of silver halide emulsion 1. Except that the amount of addition of Spectral Sensitizing dye "A" is altered to $4.5\times10^{-3}$ mol/mol Ag, the spectral sensitization, chemical sensitization, addition of 5-methyl-2-mercaptobenzoimidazole and addition of 1-phenyl-2-heptyl-5-mercapto-1,3,4-triazole were also performed similarly to those in the case of the emulsion 1, thereby to obtain a silver halide emulsion 2.

Preparation of Silver Halide Grain 3

An emulsion containing pure cubic silver bromide grain with an average sphere-equivalent diameter of 0.038 μm and a sphere-equivalent coefficient of variation of 20% was prepared similarly to the preparation of silver halide emulsion 1 except that the temperature of the mixed solution during grain formation was lowered to 27 ° C. , in place of 37° C. Precipitation/desalting/washing/dispersion were performed similarly to those in the case of silver halide emulsion 1. Except that the amount of addition of Spectral Sensitizing dye "A" is altered to $6\times10^{-3}$ mol/mol Ag, the spectral sensitization, chemical sensitization, addition of 5-methyl-2-mercaptobenzoimidazole and addition of 1-phenyl-2-heptyl-5-mercapto-1,3,4-triazole were also performed similarly to those in the case of the emulsion 1, to obtain a silver halide emulsion 3.

Preparation of Mixed Emulsion "A" for Coating Liquid

The coating liquid was prepared by mixing 70 wt % of the silver halide emulsion 1, 15 wt % of the silver halide emulsion 2 and 15 wt % of the silver halide emulsion 3, and $7\times10^{-3}$ mol/mol Ag of an 1 wt % aqueous solution of benzothiazolium iodide.

Preparation of Scaly Fatty Acid Silver Salt

A sodium behenate solution was first obtained by mixing 87.6 g of behenic acid (Edenor C22-85R, product of Henkel Corporation), 423 ml of distilled water, 49.2 ml of a 5 N aqueous NaOH solution and 120 ml of tert-butanol, and then by allowing the mixture to react at 75° C. for one hour under stirring. Independently, 206.2 ml of aqueous solution containing 40.4 g of silver nitrate (pH4.0) was prepared and kept at 10° C. A reaction vessel containing 635 ml of distilled water and 30 ml of tert-butanol was kept at 30° C., and an entire volume of the sodium behenate solution and an entire volume of the aqueous silver nitrate solution were added at constant flow rates and over 62 minutes and 10 second, and over 60 minutes, respectively. Herein only the aqueous silver nitrate solution was added in a first 7-minute-and-20-second period after the start of the addition, then the sodium behenate solution was concomitantly added, and only the sodium behenate solution was added in a last 9-minute-and-30 second period after the end of addition of the aqueous silver nitrate solution. The temperature in the reaction vessel was kept at 30° C., and was controlled externally so as to keep the liquid temperature constant. A piping in a feeding system of the sodium behenate solution was heated using a steam trace, where a steam aperture being adjusted so as to control the outlet liquid temperature at the end of the feed nozzle at 75° C. A piping in a feeding system of the aqueous silver nitrate solution was heated by circulating cold water in an outer portion of the double pipe. Points of addition of the sodium behenate solution and aqueous silver nitrate solution were symmetrically arranged centered around a stirring axis, the heights of which being adjusted so as to avoid contact to the reaction solution.

After completion of the addition of the sodium behenate solution, the mixture was allowed to stand for 20 minutes under stirring with the temperature thereof unchanged, and then cooled to 25° C. Solid content was separated by centrifugal filtration, and then washed with water until electric conductivity of the filtrate decreased as low as 30 μS/cm. A fatty acid silver salt was thus obtained. The obtained solid content was stored in a form of wet cake (concentration 45wt %) without drying.

From electron microscopic photographing, the obtained silver behenate grain was found to be a scaly crystal having average lengths of "a" =0.14 μm, "b" =0.4 μm and "c" =0.6 μm, an average aspect ratio of 5.2, an average sphere-equivalent diameter of 0.52 μm, and a sphere-equivalent coefficient of variation of 15% ( "a", "b," and "c" comply with the definition in this specification).

To the wet cake equivalent to dry weight of 100 g, 7.4 g of polyvinyl alcohol (product name; PVA-217) was added, water was further added to adjust a total volume of 385 g, and the mixture was then preliminarily dispersed using a homomixer.

The preliminarily dispersed solution was dispersed three times using a dispersion apparatus (Micro Fluidizer M-110S-EH, manufactured by Micro Fluidex International Corporation, equipped with G10Z interaction chamber) under a pressure of 1,750 kg/cm$^2$, thereby to obtain a silver behenate dispersion. During the dispersion, cooling operation was effected using coiled heat exchangers attached to the inlet and outlet of the interaction chamber, and the temperature of the coolant was controlled to keep the dispersion temperature at 18° C.

Preparation of 25 wt % Dispersion of Reducing Agent

Ten kilograms of 1,1-bis(2-hydroxy-3,5-dimethylphenyl)-3,5, 5-trimethylhexane and 10 kg of a 20 wt % aqueous solution of a modified polyvinylalcohol (Poval MP-203, manufactured by Kuraray Co., Ltd.) were added with 16 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 3 hours and 30 minutes, added with 0.2 g of benzoisothiazolinone sodium salt and water so as to adjust the concentration of the reducing agent to 25 wt %, thereby to obtain a dispersion of the reducing agent. Reducing agent grain contained in thus obtained dispersion was found to have a median diameter of 0.42 μm and a maximum diameter of 2.0 μm or less. The obtained reducing agent dispersion was filtered through a polypropylene filter with a pore size of 10.0 μm to separate dust or other foreign matters and then stored.

Preparation of 10 wt % Dispersion of Mercapto Compound

Five kilograms of 1-phenyl-2-heptyl-5-mercapto-1,3,4-triazole and 5 kg of a 20 wt % aqueous solution of a modified polyvinyl alcohol (Poval MP-203, manufactured by Kuraray Co., Ltd.) were added with 8.3 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 6 hours, added with water so as to adjust the concentration of the mercapto compound to 10 wt %, thereby to obtain a dispersion of the mercapto compound. Mercapto compound grain contained in thus obtained dispersion was found to have a median diameter of 0.40 μm and a maximum diameter of 2.0 μm or less. The obtained mercapto compound dispersion was filtered through a polypropylene filter with a pore size of 10.0 μm to separate dust or other foreign matters and then stored. The dispersion was re-filtered through the polypropylene filter with a pore size of 10.0 μm immediately before use.

Preparation of 20 wt % Dispersion-1 of Organic Polyhalogen Compound

Five kilograms of tribromomethylnaphthylsulfone, 2.5 kg of a 20 wt % aqueous solution of a modified polyvinylalcohol (Poval MP-203, manufactured by Kuraray Co., Ltd.), and 213 g of a 20 wt % aqueous solution of sodium triisopropylnaphthalenesulfonate were added with 10 kg of water, and then mixed thoroughly to prepare a slurry. The slurry was then fed with the aid of a diaphragm pump to a lateral sand mill (UVM-2 manufacture by Aimex, Ltd.) filled with zirconia bead with an average diameter of 0.5 mm, dispersed for 5 hours, added with 0.2 g of benzoisothiazolinone sodium salt and water so as to adjust the concentration of the organic polyhalogen compound to 20 wt %, thereby to obtain a dispersion of the organic polyhalogen compound. Organic polyhalogen compound grain contained in thus obtained dispersion was found to have a median diameter of 0.36 μm and a maximum diameter of 2.0 μm or less. The obtained organic polyhalogen compound dispersion was filtered through a polypropylene filter with a pore size of 3.0 μm to separate dust or other foreign matters and then stored.

Preparation of 25 wt % Dispersion-2 of Organic Polyhalogen Compound

Dispersion was performed similarly to the case with the 20 wt % dispersion-1 of the organic polyhalogen compound, except that using 5 kg of tribromomethyl[4-(2,4,6-trimethylphenylsulfonyl)phenyl] sulfone in place of 5 kg of tribromomethylnaphthylsulfone, the dispersion was then diluted so as to adjust the concentration of the organic polyhalogen compound to 25 wt % and filtered. Organic polyhalogen compound grain contained in thus obtained dispersion was found to have a median diameter of 0.38 μm and a maximum diameter of 2.0 μm or less. The obtained organic polyhalogen compound dispersion was filtered through a polypropylene filter with a pore size of 3.0 μm to separate dust or other foreign matters and then stored.

Preparation of 30 wt % Dispersion-3 of Organic Polyhalogen Compound

Dispersion was performed similarly to the case with the 20 wt % dispersion-1 of the organic polyhalogen compound except that using 5 kg of tribromomethylphenylsulfone in place of 5 kg of tribromomethylnaphthylsulfone and that increasing the amount of use of the 20 wt % aqueous solution of MP-203 to 5 kg, the dispersion was then diluted so as to adjust the concentration of the organic polyhalogen compound to 30 wt % and filtered. Organic polyhalogen compound grain contained in thus obtained dispersion was found to have a median diameter of 0.41 μm and a maximum diameter of 2.0 μm or less. The obtained organic polyhalogen compound dispersion was filtered through a polypropylene filter with a pore size of 3.0 μm to separate dust or other foreign matters and then stored. The dispersion was stored at 10° C. until it is used.

Preparation of 5 wt % Solution of Phthalazine Compound

Eight kilograms of modified polyvinyl alcohol MP-203 (product of Kuraray Co., Ltd., was dissolved in 174.57 kg of water, and 3.15 kg of a 20 wt % aqueous solution of sodium triisopropylnaphthalenesulfonate and 14.28 kg of a 70 wt % aqueous solution of 6-isopropylphthalazine were added, thereby to prepare a 5 wt % solution of 6-isopropylphthalazine.

Preparation of 20 wt % Dispersion of Pigment

Sixty-four grams of C.I. Pigment Blue 60 and 6.4 g of DEMOL-N (manufactured by Kao Corporation) were added with 250 g of water, and then mixed thoroughly to prepare a slurry. The slurry was then fed into a vessel of a dispersion apparatus (¼G Sand Grinder Mill manufacture by Aimex, Ltd.) together with 800 g of zirconia bead with an average diameter of 0.5 mm, and dispersed for 25 hours to obtain a pigment dispersion. Pigment grain contained in thus obtained dispersion was found to have an average diameter of 0.21 μm.

Preparation of 40 wt % Solution of SBR Latex

SBR latex purified by ultrafiltration (UF) was obtained as follows:

A ten-fold dilution of SBR latex [expressed as -St(68)-Bu(29)-AA(3)-] in distilled water was diluted and purified using an UF-purification module FS03-FC-FUYO3A1 (manufactured by Daicen Membrane-Systems, Ltd.) until the ion conductivity is reduced as low as 1.5 mS/cm, Sandet-BL (manufactured by Sanyo Chemical Industries) was then added so as to attain a concentration of 0.22 wt %, and NaOH and $NH_4OH$ were further added so as to attain a molar ratio of $Na^+$: $NH_4$ =1: 2.3 and a pH of 8.4. The resultant latex concentration was found to be 40 wt %. Specification of the latex is as follows:

average grain size=0.1 μm, concentration=45%, equilibrium water content at 250C, 60%RH=0.6 wt %, ion conductivity=4.2 mS/cm (measured for latex solution (40%) at 25° C. using a conductometer CM-30S manufactured by TOA Electronics Ltd.), pH8.2

Preparation of Coating Liquid for Emulsion Layer (Photosensitive Layer

Mixed were 1.1 g of the above-obtained 20 wt % dispersion of the pigment, 103 g of the organic acid silver dispersion, 5 g of a 20 wt % aqueous solution of polyvinyl alcohol PVA-205 (manufactured by Kuraray Co., Ltd.), 25 g of the above-obtained 25 wt % dispersion of the reducing agent, total 16.3 g of 5:1:3 mixture (ratio by weight) of the dispersions-1, -2 and -3 of the organic polyhalogen compounds, 6.2 g of the 10 wt % dispersion of the mercapto compound, 106 g of the 40 wt % solution of SBR latex purified by ultrafiltration (UF) and 18 ml of the 5 wt % solution of the phthalazine compound, the mixture was then added with 10 g of silver halide mixed emulsion "A", then thoroughly mixed to obtain a coating liquid for the emulsion layer, which was then directly fed to a coating die and coated in an amount of 70 ml/m$^2$.

Viscosity of the coating liquid for the emulsion layer was measured using a B-type viscometer (manufactured by Tokyo Keiki K.K.) at 40° C., (with No. 1 rotor at 60 rpm) and was found to be 85 mpa·s.

Viscosities of the coating liquid measured under shearing velocities of 0.1, 1, 10, 100 and 1,000 (1/second) at 25° C. using RFS Fluid Spectrometer (manufactured by Rheometrix Far East Inc.) were 1,500, 220, 70, 40 and 20 mPa·s, respectively.

Preparation of Coating Liquid for Intermediate Layer on the Emulsion Plane

A coating liquid for the intermediate layer was prepared by mixing 772 g of a 10 wt % aqueous solution of polyvinyl alcohol PVA-205 (manufactured by Kuraray Co., Ltd.), 226 g of a 27.5 wt % solution of methyl methacrylate/styrene/butyl acrylate/hydroxyethyl methacrylate/acrylic acid copolymer latex (copolymerization ratio by weight of 64/9/20/5/2) and 2 ml of a 5 wt % aqueous solution of Aerosol 0T (American Cyanamide Corporation), 10.5 ml of a 20 wt % aqueous solution of diammonium phthalate, and by adjusting the total weight to 880 g by adding water. The obtained coating liquid was then fed to a coating die so as to attain a coating amount of 10 ml/m$^2$.

Viscosity of the coating liquid measured at 40° C. using a B-type viscometer (with No. 1 rotor at 60 rpm) was found to be 21 mpa·s.

Preparation of Coating Liquid for First Protective Layer on the Emulsion Plane

Sixty-four grams of inert gelatin was dissolved in water, and added thereto were 80 g of a 27.5 wt % solution of methyl methacrylate/styrene/butyl acrylate/hydroxyethyl methacrylate/acrylic acid copolymer latex (copolymerization ratio by weight of 64/9/20/5/2), 23 ml of a 10 wt % methanol solution of phthalic acid, 23 ml of a 10 wt % aqueous solution of 4-methylphthalic acid, 28 ml of an 1 N sulfuric acid, 5 ml of a 5 wt % aqueous solution of Aerosol 0T (American Cyanamide Corporation), 0.5 g of phenoxyethanol, 0.1 g of benzoisothiazolinone, then the total weight was adjusted to 750 g by adding water to prepare a coating liquid. The coating liquid was added with 26 ml of a 4 wt % chrome alum solution using a static mixer immediately before the coating and fed to a coating die so as to attain a coating amount of 18.6 ml/m$^2$.

Viscosity of the coating liquid measured at 40 C. using a B-type viscometer (with No. 1 rotor at 60 rpm) was found to be 17 mpa·s.

Preparation of Coating Liquid for Second Protective Layer on the Emulsion Plane

Eighty grams of inert gelatin was dissolved in water, and added thereto were 102 g of a 27.5 wt % solution of methyl methacrylate/styrene/butyl acrylate/hydroxyethyl methacrylate/acrylic acid copolymer latex (copolymerization ratio by weight of 64/9/20/5/2), 3.2 ml of a 5 wt % solution of N-perfluorooctylsulfonyl-N-propylalanine potassium salt, 32 ml of a 2 wt % aqueous solution of polyethylene-glycolmono(N-perfluorooctylsulfonyl-N-propyl-2-aminoethyl)ether [average degree of polymerization of ethylene oxide=15], 23 ml of a 5 wt % aqueous solution of Aerosol 0T (American Cyanamide Corporation), 4 g of polymethylmethacrylate microgram (average grain size=0.7 μm), 21 g of polymethylmethacrylate micrograin (average grain size=6.4 μm), 1.6 g of 4-methylphthalic acid, 4.8 g of phthalic acid, 44 ml of an 1 N sulfuric acid, 10 mg of benzoisothiazolinone, then the total weight was adjusted to 650 g by adding water. The mixture was added with 445 ml of an aqueous solution containing 4 wt % chrome alum and 0.67% of phthalic acid using a static mixer immediately before the coating, which was fed to a coating die so as to attain a coating amount of 8.3 ml/m$^2$.

Viscosity of the coating liquid measured at 40° C. using a B-type viscometer (with No. 1 rotor at 60 rpm) was found to be 9 mpa·s.

Fabrication of Photothermographic Material

On the back plane of the undercoated support, the coating liquid for the antihalation layer and the coating liquid for the back plane protective layer were simultaneously formed by coating in a stacked manner, so as to attain a coated amount of 0.04 g/m$^2$in terms of solid content of the solid micrograin dye for the former, and 1.7 g/m$^2$ in terms of gelatin for the latter, respectively. The coated films were then dried to obtain a halation-preventive back layer.

On the opposite plane of the back plane and on the undercoat layer, an emulsion layer (in a coated amount of 0.14 g/m$^2$ as silver in the silver halide), an intermediate layer, a first protective layer and a second protective layer were formed in this order by the simultaneous multi-layer coating to obtain Sample 001 of the photothermographic material.

The coating was effected at a speed of 160 m/min while keeping a gap between the end of the coating die and the support at 0.14 to 0.28 mm, and adjusting so that coating width becomes wider than the width of the slit for ejecting the coating liquid by 0.5 mm each from the both edges, and keeping a pressure in a reduced pressure chamber lower by 392 Pa than the atmospheric pressure. Care was taken for the handling and controlling temperature and humidity so as to prevent electric charging of the support, and the support was further blown with ion wind immediately before the coating. Next, the coated liquid was cooled in a chilling zone by blowing wind with a dry-bulb temperature of 18° C. and a wet-bulb temperature of 12° C. for 30 seconds, further dried in a helical floating drying zone by blowing wind with a dry-bulb temperature of 30° C. and a wet-bulb temperature of 18° C. for 200 seconds, still further dried while being passed in a drying zone at 70° C. for 20 seconds and then in a drying zone at 90° C. for 10 seconds, then cooled to 25° C. to vaporize the solvent in the coated liquid. An average velocity of the wind blown onto the surface of the coated liquid in the chilling zone and drying zone was 7 m/s.

The degree of matting expressed as Bekk smoothness of thus-obtained photothermographic material was found to be 550 seconds for the photosensitive layer side, and 130 seconds for the back plane.

Spectral Sensitizing dye "A"

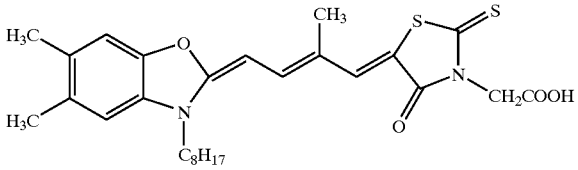

Tellurium Sensitizer "B"

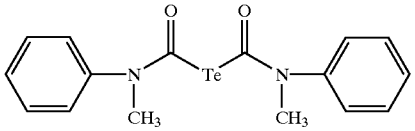

Basic Precursor Compound 11

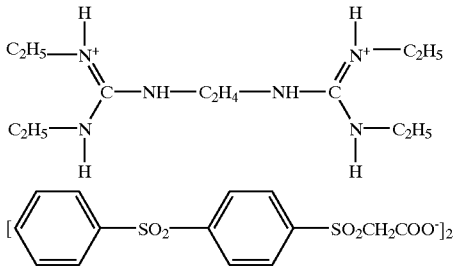

Cyanine Dye Compound 13

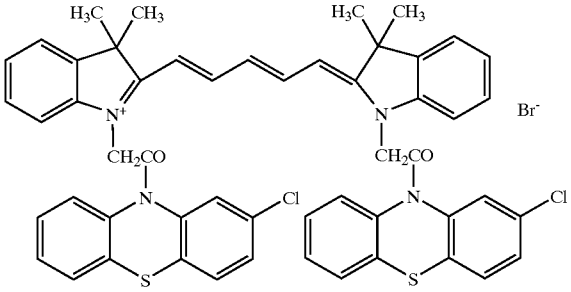

-continued

Blue Dye Compound 14

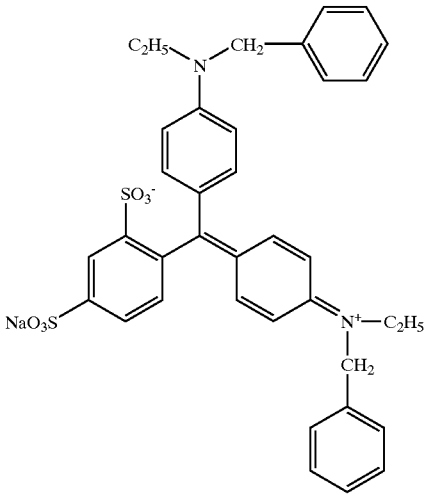

Samples 002 to 040 were also fabricated similarly to the case of Sample 1 except that species and coated amount of the reducing agent were altered to those listed in Table 1. In Table 1, the coated amounts were expressed in relative molar percent assuming the value for the reducing agent in Sample 001 as 100 mol %.

Evaluation of Photographic Performance

The Samples were exposed and heat-developed (at approx. 120° C.) with Fuji Particular Dry Laser Imager FM-DPL [equipped with a 660-nm semiconductor laser device, maximum output=60 mW (IIIB)]), and obtained images were evaluated using a densitometer.

Results were shown in Table 1.

TABLE 1

| Sample No. | Reducing Agent (I) | Coated Amount relative mol % | Reducing Agent (II) | Coated Amount relative mol % | Dmin | Dmax–Dmin | Remarks |
|---|---|---|---|---|---|---|---|
| 001 | (I-1) | 100 | — | — | 0.18 | 3.60 | comparison |
| 002 | (I-1) | 50 | — | — | 0.16 | 2.45 | comparison |
| 003 | — | — | (II-1) | 50 | 0.16 | 0.01 | comparison |
| 004 | — | — | (II-1) | 100 | 0.16 | 0.01 | comparison |
| 005 | (I-1) | 50 | (II-1) | 50 | 0.16 | 3.22 | invention |
| 006 | (I-1) | 50 | (II-1) | 100 | 0.17 | 3.65 | invention |
| 007 | — | — | (II-10) | 25 | 0.16 | 0.01 | comparison |
| 008 | — | — | (II-10) | 50 | 0.16 | 0.02 | comparison |
| 009 | (I-1) | 50 | (II-10) | 25 | 0.17 | 3.06 | invention |
| 010 | (I-1) | 50 | (II-10) | 50 | 0.17 | 3.54 | invention |
| 011 | — | — | (II-15) | 12.5 | 0.16 | 0.00 | comparison |

TABLE 1-continued

| Sample No. | Reducing Agent (I) | Coated Amount relative mol % | Reducing Agent (II) | Coated Amount relative mol % | Dmin | Dmax–Dmin | Remarks |
|---|---|---|---|---|---|---|---|
| 012 | — | — | (II-15) | 25 | 0.16 | 0.01 | comparison |
| 013 | (I-1) | 50 | (II-15) | 12.5 | 0.17 | 3.12 | invention |
| 014 | (I-1) | 50 | (II-15) | 25 | 0.17 | 3.61 | invention |
| 015 | (I-2) | 40 | — | — | 0.16 | 2.31 | comparison |
| 016 | (I-2) | 40 | (II-1) | 100 | 0.17 | 3.58 | invention |
| 017 | (I-2) | 40 | (II-10) | 50 | 0.17 | 3.48 | invention |
| 018 | (I-2) | 40 | (II-15) | 25 | 0.17 | 3.55 | invention |
| 019 | (I-3) | 25 | — | — | 0.16 | 2.18 | comparison |
| 020 | (I-3) | 25 | (II-1) | 100 | 0.17 | 3.61 | invention |
| 021 | (I-3) | 25 | (II-10) | 50 | 0.17 | 3.47 | invention |
| 022 | (I-3) | 25 | (II-15) | 25 | 0.17 | 3.56 | invention |
| 023 | (I-4) | 35 | — | — | 0.16 | 2.37 | comparison |
| 024 | (I-4) | 35 | (II-1) | 100 | 0.17 | 3.64 | invention |
| 025 | (I-15) | 30 | — | — | 0.16 | 2.28 | comparison |
| 026 | (I-15) | 30 | (II-1) | 100 | 0.17 | 3.55 | invention |
| 027 | (I-21) | 50 | — | — | 0.16 | 2.06 | comparison |
| 028 | (I-21) | 50 | (II-1) | 100 | 0.17 | 3.34 | invention |
| 029 | (I-26) | 50 | — | — | 0.16 | 2.11 | comparison |
| 030 | (I-26) | 50 | (II-1) | 100 | 0.17 | 3.47 | invention |
| 031 | (I-1) | 50 | (II-2) | 100 | 0.17 | 3.44 | invention |
| 032 | (I-1) | 50 | (II-3) | 50 | 0.17 | 3.71 | invention |
| 033 | (I-1) | 50 | (II-4) | 100 | 0.17 | 3.88 | invention |
| 034 | (I-1) | 50 | (II-7) | 50 | 0.17 | 3.52 | invention |
| 035 | (I-1) | 50 | (II-9) | 50 | 0.17 | 3.55 | invention |
| 036 | (I-1) | 50 | (II-11) | 33 | 0.17 | 3.62 | invention |
| 037 | (I-1) | 50 | (II-12) | 33 | 0.17 | 3.58 | invention |
| 038 | (I-1) | 50 | (II-16) | 50 | 0.17 | 3.50 | invention |
| 039 | (I-1) | 50 | (II-21) | 100 | 0.17 | 3.54 | invention |
| 040 | (I-1) | 50 | (II-30) | 50 | 0.17 | 3.48 | invention |

As is clear from Table 1, the hindered phenol-base reducing agents [compounds expressed by the formula (II)] showed almost no heat-developing property under the above experimental conditions, and thus yielded no image. While all of the o-polyphenol-base reducing agents [compounds expressed by the formula (I)] individually showed heat-developing property, reduction in the amount of use failed in obtaining sufficient image density after the development. On the contrary, it was found that the combined use of the o-polyphenol-base reducing agents with the hindered phenol-base reducing agents, scarcely having the development property per se, resulted in significant increase in the image density. Such so-called superadditivity has never been known in the conventional heat development system. It was indicated that the amount of use of the o-polyphenol-base reducing agents [compounds expressed by the formula (I) ], which have been causative of degraded image storability, can be reduced by combining two kinds of reducing agents according to the present invention.

Next, Samples 101 to 121 were fabricated, in which the coated amount of the o-polyphenol-base reducing agents [compounds expressed by the formula (I) ] and the hindered phenol-base reducing agents [compounds expressed by the formula (II)] were adjusted so as to give a development density almost equivalent to that of Sample 1, and the image storability thereof were evaluated.

That is, the photosensitive materials after the development were stored under the a condition of 55° C.-RH60% for 7 days, and the evaluation was made based on the difference between the image densities of the white background region measured before and after the storage (ΔDmin).

Results were shown in Table 2.

TABLE 2

| Sample No. | Reducing Agent (I) | Coated Amount relative mol % | Reducing Agent (II) | Coated Amount relative mol % | Dmax–Dmin | ΔDmin | Remarks |
|---|---|---|---|---|---|---|---|
| 101 | (I-1) | 100 | — | — | 3.60 | 0.28 | comparison |
| 102 | — | — | (II-1) | 100 | 0.01 | 0.03 | comparison |
| 103 | — | — | (II-10) | 50 | 0.02 | 0.03 | comparison |
| 104 | — | — | (II-15) | 25 | 0.01 | 0.02 | comparison |
| 105 | (I-1) | 60 | (II-1) | 50 | 3.57 | 0.13 | invention |
| 106 | (I-1) | 50 | (II-1) | 100 | 3.65 | 0.18 | invention |
| 107 | (I-1) | 50 | (II-10) | 50 | 3.54 | 0.07 | invention |
| 108 | (I-1) | 50 | (II-15) | 25 | 3.61 | 0.08 | invention |
| 109 | (I-2) | 90 | — | — | 3.58 | 0.24 | comparison |
| 110 | (I-2) | 40 | (II-1) | 100 | 3.58 | 0.11 | invention |
| 111 | (I-2) | 45 | (II-10) | 50 | 3.60 | 0.09 | invention |
| 112 | (I-2) | 60 | (II-10) | 25 | 3.56 | 0.11 | invention |
| 113 | (I-2) | 42 | (II-15) | 25 | 3.59 | 0.08 | invention |
| 114 | (I-3) | 50 | — | — | 3.64 | 0.36 | comparison |
| 115 | (I-3) | 25 | (II-1) | 100 | 3.61 | 0.15 | invention |

TABLE 2-continued

| Sample No. | Reducing Agent (I) | Coated Amount relative mol % | Reducing Agent (II) | Coated Amount relative mol % | Dmax–Dmin | ΔDmin | Remarks |
|---|---|---|---|---|---|---|---|
| 116 | (I-3) | 30 | (II-10) | 50 | 3.59 | 0.11 | invention |
| 117 | (I-3) | 25 | (II-15) | 25 | 3.56 | 0.09 | invention |
| 118 | (I-3) | 30 | (II-15) | 20 | 3.57 | 0.1o | invention |
| 119 | (I-3) | 35 | (II-15) | 15 | 3.60 | 0.12 | invention |
| 120 | (I-4) | 70 | — | — | 3.62 | 0.30 | comparison |
| 121 | (I-4) | 35 | (II-1) | 100 | 3.64 | 0.13 | invention |

As is clear from Table 2, the combinations of the reducing agents according to the present invention significantly improved the image storability.

What is claimed is:

1. A photothermographic material containing on one side of a support at least one photosensitive silver halide, a non-photosensitive organic silver salt, a reducing agent for reducing silver ion and a binder, in which the reducing agent comprises a combination of at least one compound. expressed by the formula (I) below and at least one compound expressed by the formula (II) below:

formula (I)

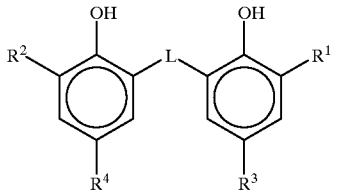

(where in the formula (I), $R^1$ to $R^4$ independently represent a hydrogen atom or a group substitutable on a. benzene ring; L represents an —S— group or a —$CHR^5$— group; said $R^5$ representing a hydrogen atom or an alkyl group); and formula (II)

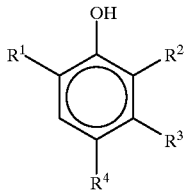

(where in the formula (II), $R^1$ represents an alkyl group whereas excluding 2-hydroxyphenylmethyl group; $R^2$ represents a hydrogen atom, an acylamino group or an alkyl group having 1 to 30 carbon atoms; $R^3$ represents a hydrogen atom or an alkyl group; and $R^4$ represents a group substitutable on a benzene ring).

2. A photothermographic material of claim 1 wherein $R^1$ to $R^4$ in the formula (I) independently represent an alkyl group having 1 to 24 carbon atoms.

3. A photothermographic material of claim 2 wherein $R^1$ and $R^2$ in the formula (I) independently represent tertiary alkyl group.

4. A photothermographic material of claim 1 wherein $R^1$ in the formula (II) represents a group exhibiting larger steric hindrance than isopropyl group.

5. A photothermographic material of claim 4 wherein $R^1$ in the formula (II) represents tertiary alkyl group.

6. A photothermographic material of claim 1 wherein $R^2$ in the formula (II) represents a hydrogen atom or unsubstituted alkyl group having 1 to 24 carbon atoms.

7. A photothermographic material of claim 1 wherein $R^3$ in the formula (II) represents a hydrogen atom or unsubstituted alkyl group having 1 to 24 carbon atoms.

8. A photothermographic material of claim 1 wherein either one of $R^2$ and $R^3$in the formula (II) represents a hydrogen atom.

9. A photothermographic material of claim 1 wherein $R^4$ in the formula (II) represents an alkyl group having 1 to 24 carbon atoms.

10. A photothermographic material of claim 1 wherein each of said at least one .compound of formula (I) and said at least one compound of formula (II) is contained in an amount of 0.01 to 4.0 g/$m^2$.

11. A photothermographic material of claim 10 wherein each of said at least one compound of formula (I). and said at least one compound of formula (II) is contained in an amount of 0.1 to 2.0 g/$m^2$.

12. A photothermographic material of claim 1 wherein the molar ratio of said at least one compound of formula (I) to said at least one compound of formula (II) is 0.001 to 10.

13. photothermographic material of claim 12 wherein the molar ratio. of at least one compound of formula (I) to said at least one compound of formula (II) is 0.1 to 10.

14. A photothermographic material of claim 1 wherein an organic silver salt-containing layer of the material is formed by coating and drying a coating liquid in which water accounts for 30wt % or above of the solvent thereof and a polymer latex as the binder.

* * * * *